US006041860A

United States Patent [19]

Nazzal et al.

[11] Patent Number: 6,041,860

[45] Date of Patent: Mar. 28, 2000

[54] APPARATUS AND METHOD FOR PERFORMING IMAGING AND DOWNHOLE OPERATIONS AT A WORK SITE IN WELLBORES

[75] Inventors: Gregory R. Nazzal, Kingwood; Paulo S. Tubel, The Woodlands; Gerald D. Lynde, Houston; John W. Harrell, Spring; James V. Leggett, III, Houston, all of Tex.

[73] Assignee: Baker Hughes Incorporated, Houston, Tex.

[21] Appl. No.: 08/893,312

[22] Filed: Jul. 16, 1997

Related U.S. Application Data

[60] Provisional application No. 60/021,931, Jul. 17, 1996, provisional application No. 60/025,330, Sep. 3, 1996, and provisional application No. 60/029,257, Oct. 25, 1996.

[51] Int. Cl.[7] ..... E21B 47/00

[52] U.S. Cl. ..... 166/250.01; 166/250.17; 73/152.01

[58] Field of Search ..... 166/250.01, 253.1, 166/255.2, 250.08, 250.09, 250.17, 55.1, 66, 222, 223; 73/152.01, 152.17

[56] References Cited

U.S. PATENT DOCUMENTS

| | | | |
|---|---|---|---|
| 2,912,495 | 11/1959 | Moon et al. | 178/6.8 |
| 3,046,601 | 7/1962 | Hubbert et al. | 18/6 |
| 3,279,085 | 10/1966 | Reinhart | 33/205.5 |
| 3,288,210 | 11/1966 | Bryant | 166/4 |
| 3,596,582 | 8/1971 | Sayer | 95/11 |
| 3,960,212 | 6/1976 | Hutchinson | 166/250 |
| 3,984,627 | 10/1976 | Galerne | 178/6.8 |
| 4,238,158 | 12/1980 | Sington | 356/241 |
| 4,331,975 | 5/1982 | Krawza et al. | 358/100 |
| 4,532,545 | 7/1985 | Hanson | 358/100 |
| 4,774,573 | 9/1988 | Mount, II et al. . | |
| 4,800,753 | 1/1989 | Despax et al. | 73/151 |
| 4,855,820 | 8/1989 | Barbour | 358/100 |
| 4,938,060 | 7/1990 | Sizer et al. | 73/151 |
| 5,134,471 | 7/1992 | Gendron et al. | 358/100 |
| 5,140,319 | 8/1992 | Riordan | 340/854.9 |
| 5,153,718 | 10/1992 | Massar . | |
| 5,275,038 | 1/1994 | Sizer et al. | 73/151 |
| 5,402,165 | 3/1995 | Linville et al. | 348/85 |
| 5,412,568 | 5/1995 | Schultz | 166/250.01 |
| 5,440,081 | 8/1995 | Thompson | 181/102 |
| 5,477,505 | 12/1995 | Drumheller | 166/250.01 |
| 5,550,331 | 8/1996 | Thompson | 181/102 |
| 5,579,842 | 12/1996 | Riley | 166/250.01 |
| 5,647,435 | 7/1997 | Owens et al. | 166/250.01 |
| 5,651,415 | 7/1997 | Scales | 166/250.09 |
| 5,767,400 | 6/1998 | Nakano et al. | 166/255.2 |

FOREIGN PATENT DOCUMENTS

| | | |
|---|---|---|
| 0 753 647 A2 | 1/1997 | European Pat. Off. . |
| 2 664 327 | 1/1992 | France . |
| 25 14 291 | 10/1976 | Germany . |
| 2 129 350 | 5/1984 | United Kingdom . |
| 2 270 099 | 3/1994 | United Kingdom . |
| WO 97/12113 | 4/1997 | WIPO . |

*Primary Examiner*—William Neuder
*Attorney, Agent, or Firm*—Madan, Mossman & Sriram, P.C.

[57] ABSTRACT

The present invention provides a downhole service tool for imaging a location constituting a work site of interest downhole at which a tool operation is to be performed in a preexisting wellbore and for performing a tool operation at the work site during a single trip of the tool, The downhole service tool includes an imaging device which sensors properties associated with the work site and generates data representative of the work site. The imaging date is transmitted to the surface via a two-way telemetry system. An end work device in the downhole service tool performs the desired tool operation at the desired work site. The service tool images the work site, communicates imaging data to the surface and performs the desired operation during a single trip into the wellbore.

62 Claims, 15 Drawing Sheets

APPARATUS AND METHOD FOR PERFORMING IMAGING AND DOWNHOLE OPERATIONS AT A WORK SITE IN WELLBORES

This application claims benefit of provisional application 60/021,931, filed Jul. 17, 1996, provisional application 60/025,330, filed Sep. 3, 1996, and provisional application 60/029,257, filed Oct. 25, 1996.

BACKGROUND OF THE INVENTION

1. Field of the Invention

This invention relates generally to downhole tools for use in wellbores and more particularly to tools which can image a work site or an object in a wellbore, communicate with the surface and perform a desired end work or service at the work site, during a single trip in the wellbore. The present invention also provides novel imaging devices and end work devices and various downhole tool configurations for imaging worksites and performing the desired end works.

2. Background of the Art

To produce hydrocarbons (oil and gas) from the earth's formations, wellbores (also referred to in industry as boreholes) are formed to desired depths. The shallow portion of the wellbore is typically large in diameter, which is lined with a metal casing to prevent caving of the wellbore. The wellbore is then drilled to a desired depth to recover hydrocarbons from the subsurface formations. After the wellbore has been drilled, a metal pipe, generally referred to in the art as the casing or pipe, is set in the wellbore by injecting cement through the annulus between the casing and the wellbore. Branch or lateral wellbores are frequently drilled from a main wellbore to form deviated or horizontal wellbores for improving production of hydrocarbons from the subsurface formations.

A large proportion of the current drilling activity involves directional drilling, i.e., drilling deviated and horizontal wellbores, to improve the hydrocarbon production and/or to withdraw additional hydrocarbons from the earth's formations. The wellbores are then completed and put into production. The drilling and completion processes involve a number of different operations. Such operations may include cutting and milling operations (including cutting relatively precise windows in the wellbore casings), sealing junctures between intersecting wellbores, welding, re-entering lateral wellbores, perforating, setting devices such as plugs, sliding sleeves, packers and sensors, remedial operations, sealing, stimulating, cleaning, testing and inspection including determining the quality and integrity of a juncture, testing production from a perforated zone or a portion thereof, collecting and analyzing fluid samples, and analyzing cores.

Oilfield wellbores usually continue to produce hydrocarbons for many years. Various types of operations are performed during the life of producing wellbores. Such operations include removing, installing and replacing different types of devices, including fluid flow control devices, sensors, packers or seals, remedial work including sealing off zones, cementing, reaming, repairing junctures, milling and cutting, freeing stuck sleeves, diverting fluid flows, controlling production from perforated zones, setting sleeves, and testing wellbore production zones or portions thereof.

Typically, to perform downhole operations at a work site in a preexisting wellbore, whether during the drilling, completion, production, or servicing and maintaining the wellbore, a desired tool is conveyed downhole, positioned into the wellbore at the work site and the desired operation is performed. Most of the prior art tools are substantially mechanical tools or electro-mechanical tools. Such tools lack downhole maneuverability, in that the various elements of the tools do not have sufficient degrees of freedom of movement, lack local or downhole intelligence, do not obtain sufficient data with respect to the work site or of the operation being performed, do not provide an image of the work site during the trip made for performing the end work, and do not provide confirmation of the quality and integrity of the work performed. Such prior art tools usually require multiple trips downhole to image a work site, perform an operation and then to confirm whether the operation has been properly performed. Multiple downhole trips can be very expensive, due to the rig or production down time.

The present invention addresses some of the above-noted problems and provides downhole service tools (also referred to as the downhole tool or service tool) which can be positioned and oriented adjacent a desired work site, images of the work site to the surface, perform the desired work at the work site and confirm or inspects the quality of the work during a single trip into a preexisting wellbore. The present invention provides imaging devices, end work devices and various downhole tool configurations to image work sites and to perform desired operations in preexisting wellbores. The imaging devices include an optical viewing device, an inflatable imaging device, ultrasonic devices and a tactile device. The end work devices include cutting devices, reentry devices, sealing devices, welding devices, testing and servicing devices.

SUMMARY OF THE INVENTION

The present invention provides a downhole tool for imaging a location constituting a work site of interest in a preexisting wellbore and for performing a tool operation at the work site during a single trip in the wellbore. The downhole tool includes an imaging device for imaging the work site and an end work device for performing a desired operation or an end work at the work site. The imaging device may determine the image downhole and transmit the image to the surface or transmit the image data for processing at the surface. The downhole tool may be conveyed into the wellbore by any suitable method, including a wireline, a tubing, and a robotics device that moves the downhole tool inside the wellbore.

Any suitable imaging device may be utilized for the purpose of this invention, including a camera for optical viewing, microwave device, contact device (tactile device) such as a probe or a rotary device, an acoustic device, ultrasonic device, infra-red device and radio frequency ("RF") device.

The end work devices may include a fishing tool to engage a fish downhole, whipstock, diverter, re-entry tool, packer, seal, plug, perforating tool, fluid stimulation tool, fluid fracturing tool, milling tool, cutting tool, patch tool, drilling tool, cladding tool, welding tool, deforming tool, sealing tool, cleaning tool, tool for installing a device, tool for removing a device; setting device, testing device, an inspection device, acidizing tool, an anchor, and a tool that engages with a downhole object.

In the downhole tools of the present invention, one or more devices are provided to position and orient the imaging device and the end work device as desired. Each downhole tool preferably includes a computer or processor and associated memory for storing therein models and programs for controlling the operations of the imaging device and the end work device. A surface computer receives the data from the downhole tool and displays the image of the work site for use by an operator. A two-way telemetry system provides communication between the surface computer and the downhole tool.

The present invention also provides ultrasonic imaging devices, including a device which can image radially and downhole (in front) of the downhole tool. In one mode, the ultrasonic imaging device transmits signals by sweeping a preselected frequency range to obtain an effective operating frequency. The device then continues to operate the transmitter at such effective frequency to generate data representative of the attributes of the work site.

The present invention also provides an imaging device for obtaining still and/or video pictures of a work site in the wellbore. This viewing device includes a camera or another suitable device for taking the pictures and a mechanism to displace the non-transparent fluid in the wellbore with a transparent fluid. This invention further provides an inflatable device for providing the image of an object in the wellbore when such device is inflated and urged against the object.

The downhole tool may further include sensors for providing information about the condition of the downhole tool in the wellbore. Such sensors may include sensors for determining temperature, pressure, fluid flow, pull force, gripping force, tool centerline position, tool configuration, inclination, and acceleration. Formation evaluation sensors and other sensors to log the wellbore may also be included in the downhole tool of the present invention.

The present invention also provides certain end work devices, including a high pressure fluid cutting tool, which includes a source of supplying a fluid at a relatively high pressure and a cutting element for discharging the high pressure fluid. The fluid source may include serially arranged pressure stages, wherein each such stage increases the fluid pressure above its preceding stage. The fluid may be pulsed prior to supplying it to the cutting element. A control unit controls the position and orientation of the cutting element relative to the work site. The control unit may be programmed to cut according to a predetermined pattern provided to the control unit.

In each of the downhole tools of the present invention, the operation of the imaging device and the end work device may be controlled from the surface and/or by the computer or processor in the downhole tool.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For a detailed understanding of the present invention, reference should be made to the following detailed description of the preferred embodiment, taken in conjunction with the accompanying drawings, in which like elements have been given like numerals, and wherein.

DETAILED DESCRIPTION OF PREFERRED EMBODIMENTS

Figure 1:
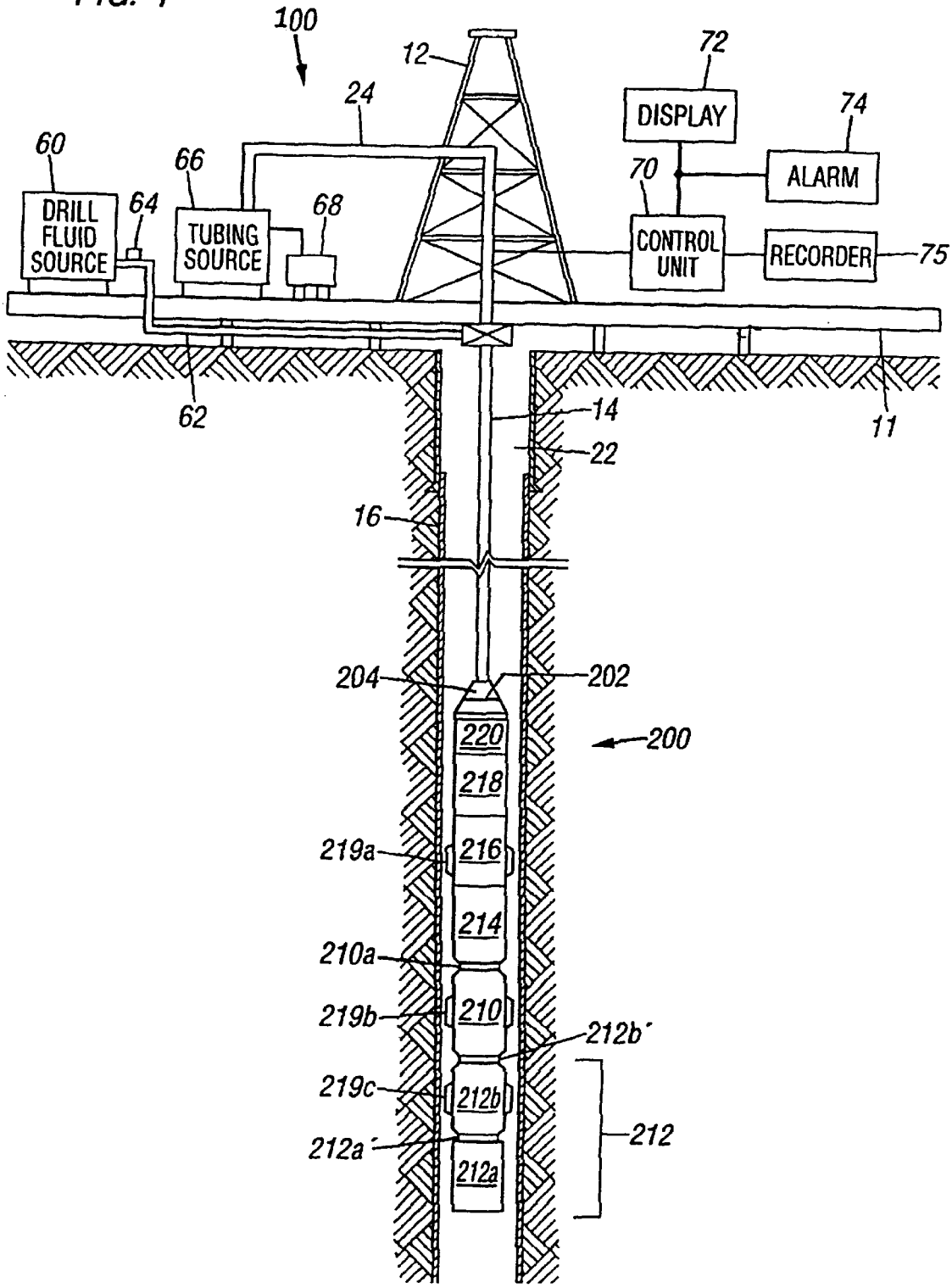
FIGS. 1 and 1A are schematic diagrams of a system utilizing a service tool conveyed into a wellbore for imaging a work site in the wellbore and performing a desired operation at the work site during a single trip according to one embodiment of the present invention.

FIG. 1 is a schematic diagram of a system 100 for use in oilfield wellbores for imaging a work site, communicating data about the image to the surface and performing a desired operation (endwork) at the work site during a single trip in the wellbore. The system 100 includes a downhole service tool 200 (also referred to herein as the downhole tool or the service tool) conveyed from a platform 11 of a rig 12 into a wellbore 22 by a suitable conveying device 24 from a source 66 thereof, such as a reel, being operated by a prime mover 68. As an example, and not as any limitation, FIG. 1 shows the conveying device 24 to be a coiled-tubing. Other conveying methods, such as wireline or robotics devices may also be utilized. The upper end 202 of the service tool is connected to the tubing 24 via a suitable connector 204. During operations, a drilling fluid from a source thereof 60 may be supplied to the wellbore 22 by a pump 68.

A surface control unit 70 placed at a suitable location on the rig platform 11 preferably controls the operation of the system 100. The control unit 70 includes a suitable computer and memory for processing data, providing selected information to an operator on a display 72, including images of the work site, logs during tripping of the wellbore, location (depth) of the tool 200 in the wellbore and orientation of the various elements of the service tool 200 in the wellbore 22 and values of selected tool, formation and wellbore parameters. The data from the service tool 200 may be transmitted to the surface by a suitable data link (telemetry) and recorded by a recorder 75 for later use. Suitable alarms 74, coupled to the control unit 70, are selectively activated by the control unit 70 when certain operating parameters exceed their respective limits. The operation of control units, such as the control unit 70, is known and is, thus, not described in detail herein.

The service tool 200 includes one or more imaging devices or image sensors 210 for imaging work sites downhole, one or more end work devices 212*a*–212*b*, one or more control mechanisms (hydraulic or electro-mechanical) 214 for controlling the operation of the end work devices 212*a*–212*b* and/or the imaging devices 210. The tool 200 may also include other sensors and devices, generally denoted herein by numeral 216, for determining desired parameters or characteristics relating to the tool 200 and the wellbore 22. Such sensors and devices may include devices for measuring temperature and pressure inside the tool 200 and in the wellbore 22, sensors for determining the depth of the tool in the wellbore 22, position (x, y, and z coordinates) of the tool 200, inclinometer for determining the inclination of the tool 200 in the wellbore 22, gyroscopic devices, accelerometers, devices for determining the pull force, center line position, gripping force, tool configuration and devices for determining the flow of fluids downhole.

The tool 200 further may include one or more formation evaluation tools for determining the characteristics of the formation surrounding the tool in the wellbore. Such devices may include gamma ray devices and devices for determining the formation resistivity. The tool 200 may include devices for determining the wellbore inner dimensions, such as calipers, casing collar locator devices for locating the casing joints and determining and correlating tool 200 depth in the wellbore 22, casing inspection devices for determining the condition of the casing, such as casing 16 for pits and fractures. The formation evaluation sensors, depth measuring devices, casing collar locator devices and the inspection devices may be used to log the wellbore while tripping into and or out of the wellbore 22.

The service tool 200 preferably includes a central electronic and data processing unit or downhole control unit or circuit 218 for receiving signals and data from downhole devices, processing such data, communicating with the surface control unit 70 and for controlling the operations of the downhole devices. The control unit 218 preferably includes one or more processors (micro-controllers or micro-processors) for performing data manipulation according to programmed instructions provided thereto from the surface or stored in memory in the downhole tool 200.

Figure 17:
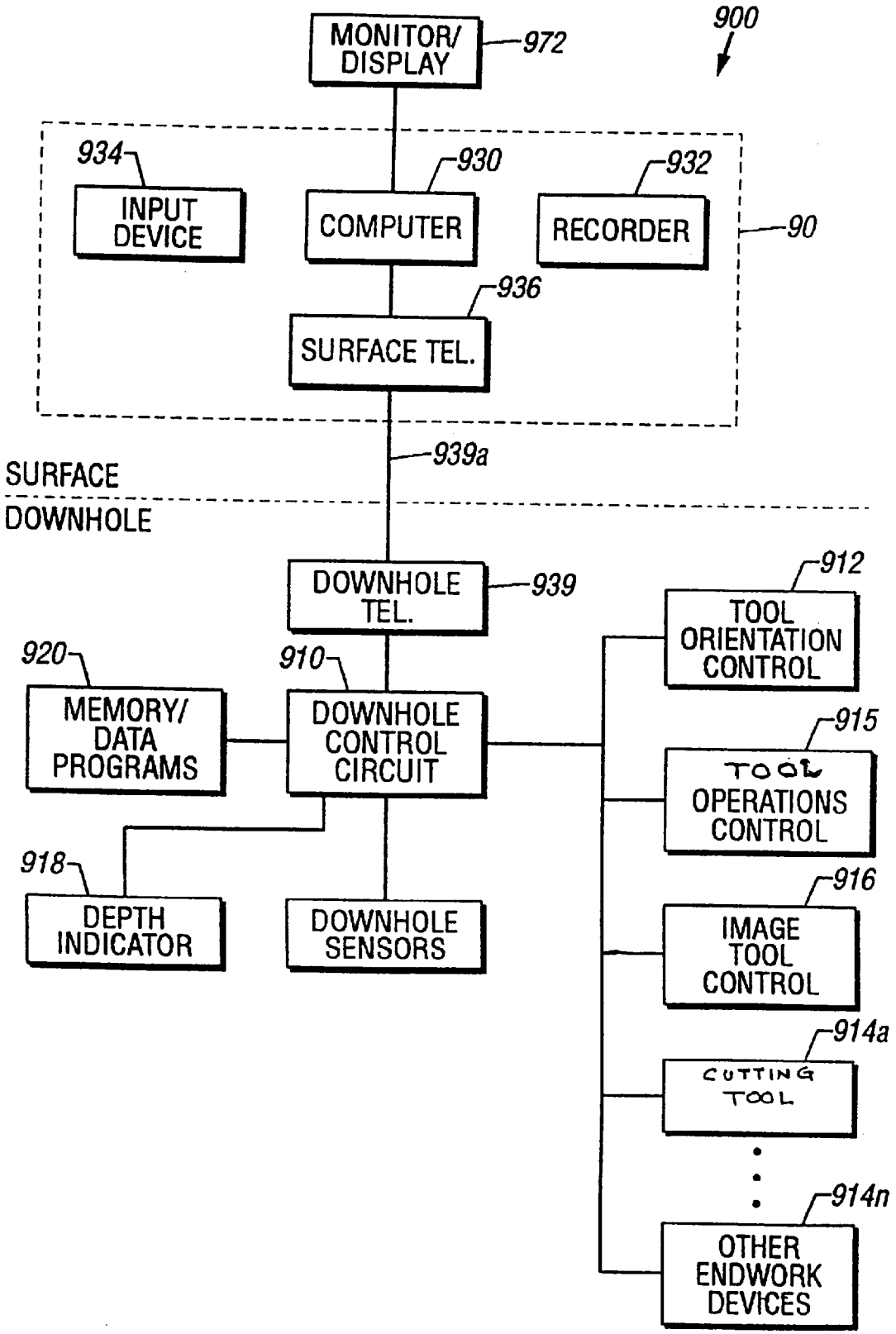
FIG. 17 is a schematic functional block diagram relating to the general operation of the downhole imaging and servicing tools of the present invention.

The service tool 200 preferably includes a two-way telemetry 220 that includes a transmitter for receiving data including the image data, from the control unit 218, downhole sensors and devices and transmits signals representative of such data to the surface control unit 70. Any suitable transmitter may be utilized for the purpose of this invention including an electromagnetic transmitter, a fluid acoustic transmitter, a tubular fluid transmitter, a mud pulse transmitter, a fiber optics device and a conductor. The telemetry system 220 also includes a receiver which receives signals transmitted from the surface control unit 70 to the tool 200. The receiver communicates such received signals to the various devices in the tool via the control unit 218 as explained later in reference to FIG. 17.

Still referring to FIG. 1, the imaging sensor or device 210 may be any suitable sensor including a camera for optical viewing, microwave device, contact device (tactile device), such as a probe or a rotary device, an acoustic device, ultrasonic device, infra-red device, or RF device. The imaging sensor 210 may be a non-contacting device, such as an ultrasonic device, or a contacting device that has one or a series of projections from the tool 200 that engage with the wellbore and objects in the wellbore. If the quality or resolution of the image of the work site provided by the imaging device 210 depends, at least in part, on the frequency of the transmitted signal by the imaging device 210, then it is preferred to adapt the device to sweep the frequency in a predetermined range of frequencies to determine an effective frequency and then obtain the image at such effective frequency. The imaging sensor 210 may be employed to provide a still or motion picture of a work site or an object downhole, or to determine the general shape of the object or the work site or to distinguish certain features of the work site prior to, during and/or after the desired operation has been performed at the work site.

Still referring to FIG. 1, the end work devices 212*a* and 212*b* may include any device for performing a desired operation at the work site in the wellbore. The end work device 212*a*–212*b* may include a fishing tool adapted to grab a fish downhole, whipstock, diverter, re-entry tool, packer, seal, plug, perforating tool, fluid stimulation tool, fluid fracture tool, milling tool, cutting tool, drilling tool, workover tool, testing tool, cementing tool, welding tool, an anchor, acidizing tool or inspection tool. As noted earlier, one or more end work devices 221*a*–212*b* may be included in the tool 200 for performing the desired operations at one or more work sites in the wellbore. Use of certain of these devices with an imaging sensor is described below as examples.

Additionally, the service tool 200 may include downhole controllable stabilizers 219*a* and 219*b*, each such stabilizer having a plurality of independently adjustable pad segments for providing lateral movement and lateral stability to the tool 200 and for anchoring the tool 200 in the wellbore 22. Such stabilizers are especially useful in deviated and horizontal wellbores. A plurality of independently controlled outwardly extending arms 219*c* may be utilized to provide lateral movement and stability to the tool 200 within the wellbore 22. For a majority of the downhole imaging and servicing applications the end work device utilized is designed for the specific application. In some applications, several end work devices may be incorporated into the service tool 200. To provide desired degrees of freedom for each of the end work devices 212*a*–212*b* and the imaging device 210, such devices are coupled to the tool via knuckle joints, such as joints, 212*a*', 212*b*' and 210*a* respectively. The movement of such knuckle joints is preferably controlled by the control unit 218. The degrees of freedom present in the tool 200 and the type of image sensor utilized preferably allow obtaining the image of any work site in the wellbore.

The service tool 200 is preferably modular in design, in that selected devices in the tool are individual modules that can be interconnected to each other to assemble the desired configuration of the tool 200. It is preferred to form the image device 210 and the end work devices 212*a*–212*b* as modules so that they can be placed in any order in the tool 200. Also, each of the end work devices 212*a*–212*b* and the image device 210 have independent degrees of freedom so that the tool 200 and any of the devices can be positioned, maneuvered and oriented in the wellbore in substantially any desired manner to perform the desired downhole operations.

The service tool 200 may be conveyed into the wellbore by a wireline, a coiled-tubing, a drill pipe, a downhole thruster or locomotive for pushing the tool 200 into a horizontal wellbore or a robotics device on the tool to move and guide the service tool in the wellbore.

Figure 1A:
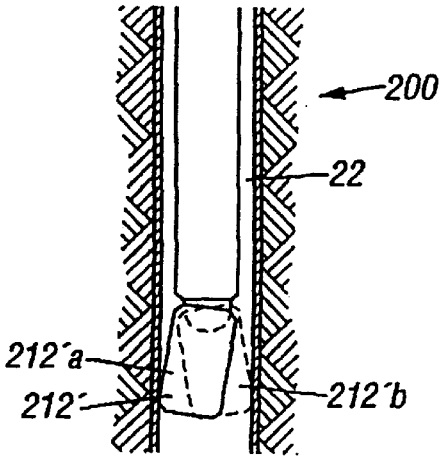

As shown in FIG. 1A, the end work device 212' or any other device in the tool 220 may have independently controlled downhole movements, such as shown by the solid lines 212'*a* and dotted lines 212'*b*, which allow the device 212' to be positioned at any angle in the wellbore 22. Thus, the service tool 200 can be positioned adjacent to a work site in a wellbore, image the work site, communicate such images online to the surface, perform the desired work at the work site, and confirm the work performed during a single trip into the wellbore.

As noted-above, the system 100 may utilize any number of different imaging devices and end work devices. A number of such tool combinations are described below. Prior to describing such tools, a novel cutting and milling device and imaging sensors are first described while referring to FIGS. 2–4.

Figure 2:
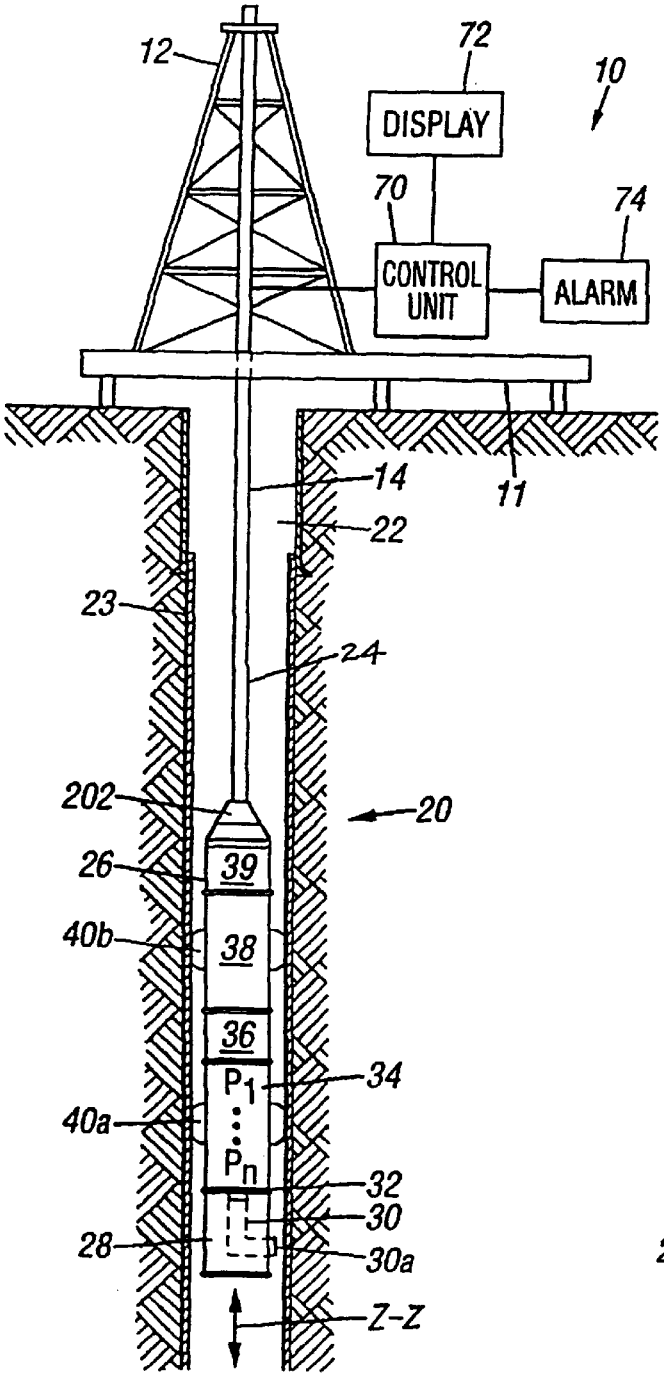
FIG. 2 is a schematic diagram of a pressurized fluid cutting tool as an end work device for use in the system of FIG. 1.

FIG. 2 shows a schematic diagram of the system utilizing a novel high pressure fluid cutting device or tool 20 for cutting and milling materials in the wellbore 22 according to one embodiment of the present invention. In general, the cutting tool includes a cutting element such as a nozzle, for discharging a relatively high pressure fluid to cut the member. A source of supplying the high pressure fluid in the downhole tool provides the high pressure fluid to the cutting element. The cutting element may be continuously positioned and oriented at the desired location about the member to be cut by a control circuit contained in the downhole tool and/or at the surface.

The cutting tool 20 has a tubular housing (body) 26, which is adapted for connection with the conveying device 24 via a suitable connector 202. The housing 26 contains the various elements of the cutting tool 20, which include a cutting element section 28, a power section 34 for supplying pressurized fluid to the cutting element section 28, a control unit 36 which controls the vertical and radial position of the control element 28 and a downhole control unit 38 for housing the circuits and memories associated with the downhole tool 20.

The bottom section 28 of the housing 26 houses a cutting element 30 that terminates in a nozzle or probe 30*a* suitable for discharging a relatively high pressure fluid in the form of a jet stream of a relatively small cross-sectional area. For the majority of downhole cutting or milling applications, water discharged at a pressure greater that 60,000 psi is adequate in removing materials from within a wellbore. In cutting pipes, which are more than one-half inch thick, higher pressure may be required. The section 28 preferably rotates about the joint 32, which connects the section 28 with a hydraulic power section, generally denoted herein by numeral 34.

The power section 34 preferably includes a plurality of serial sections $P_1$–$P_n$, each of which increases the pressure of a fluid above the pressure of the preceding section by a predetermines amount. The last section $P_n$ discharges the fluid into the cutting element 30 at the desired pressure. The power section 34 also may contain a device 33 which pulses the fluid at a predetermined rate before it is supplied to the cutting element 30. High pressure pulsed jet stream is generally more effective in cutting materials than non-pulsed jet streams. The cutting element 30 may be a telescopic member that is moved along the tool's longitudinal axis z-z (axially) within the section 28 which enables positioning the probe 30*a* at the desired depth adjacent to the wellbore. In an alternative embodiment, the section 28 may be fixed while the nozzle 30 may be rotated radially about the tool longitudinal axis. The above described movements of the cutting element 30 provide multiple degrees of freedom, i.e., along the axial and radial direction thereby allowing accurate positioning of the nozzle 30 at any desired location within the wellbore.

Figure 4:
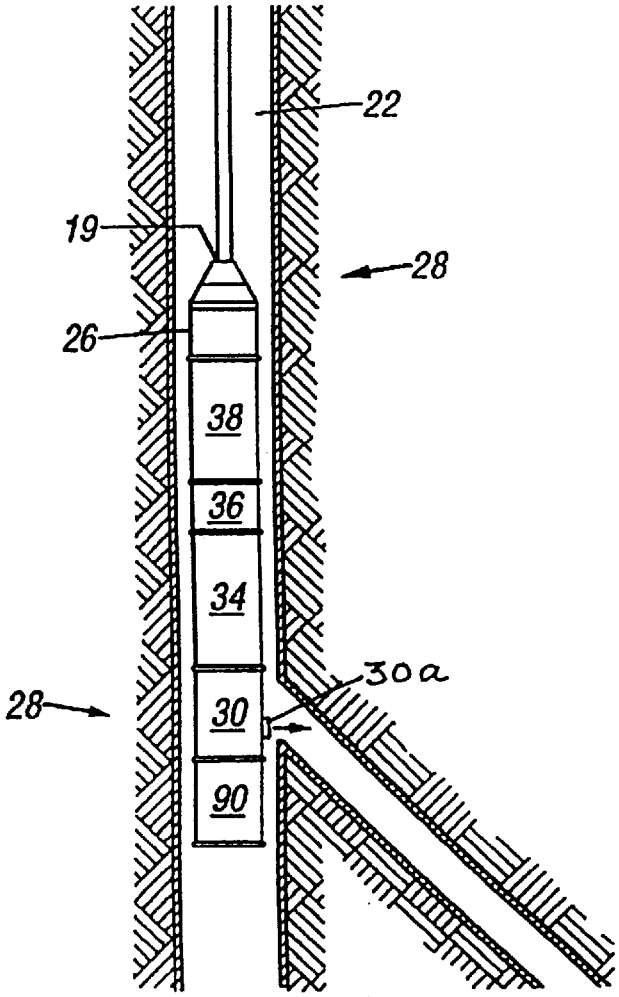
FIG. 4 is a schematic diagram of the cutting tool shown in FIG. 1 with a downhole imaging device for obtaining images of areas to be cut before and after the cutting operation.

A section 36 contains devices for orienting the nozzle tip 30*a* at the desired position. The cutting element section 28 is rotated about the wellbore axis to radially position the nozzle tip 32*a*. The cutting element 30 is moved axially to position the nozzle tip 30*a* along the wellbore axis z-z. Hydraulically operated devices or electric motors are preferably utilized for performing such functions. The section 36 also preferably includes sensors for providing information about the tool inclination, nozzle position relative to the material to be cut and relative to one or more known reference points in the tool. Such sensors, however, may be placed at any other desired locations in the tool 20. In the configuration shown in FIG. 2, the cutting element 30 can cut materials along the wellbore interior, which may include the casing or an area around a junction between the wellbore 22 (main wellbore) and a branch wellbore, as shown in FIG. 4. To cut the casing 23, the cutting element 30*a* is positioned at a desired location. As the tool 20 starts to cut the casing 23, it is rotated to circumferentially cut the pipe. If concentric casings are present, the fluid pressure may be increased accordingly to cut concentric pipes.

Figure 2A:
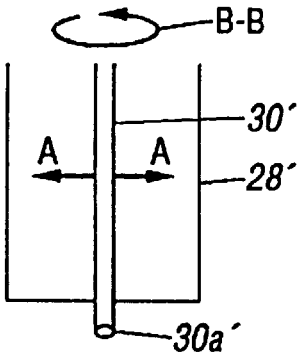
FIG. 2A shows a manner of positioning the cutting element of the cutting tool shown in FIG. 2 in a wellbore to cut material located downhole of the cutting tool.

FIG. 2A shows a configuration of a cutting element 30' that may be utilized to cut materials below the cutting tool 20. In this configuration, the probe 30*a*' discharges the fluid downhole of the tool 20. Arrows A—A indicate that the cutting element 30' may be moved radially while the circular motion defined by arrows B—B indicates that the cutting element 30' may be moved along a circular path within the section 28'. The cutting element configuration shown in FIG. 2A is useful for performing reaming operations in a tubular member, such as a production tubing, which are required when interior of such tubing is lined with sediments.

Figure 2B:
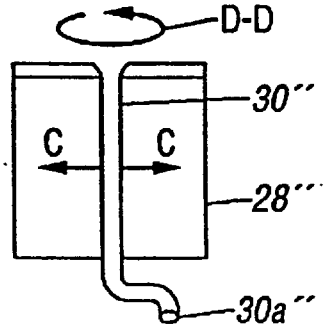
FIGS. 2B–C show alternative ways to position the cutting element of the downhole cutting tool shown in FIG. 2 to cut materials located downhole of the cutting tool.
Figure 2C:
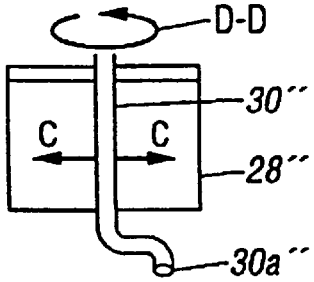

To remove a permanent packer difficult to remove, it is desirable to remove (cut away) only the packing elements and the associated anchors, if any, which typically lie between a packer body and the wellbore interior. The packers and anchors typically engage the casing at areas that are relatively smaller than the tool body. Prior art tools typically cut through the entire packer, which can take excessive time. The packers can readily be removed by only cutting the packing elements and any associated anchors disposed between the packer and the casing. In such applications, the cutting nozzle needs to be positioned over the packing element alone. FIGS. 2B–C show a configuration of the cutting element 30" whose nozzle 30*a*" may be placed at any desired location above a packing element within the wellbore and then rotated to cut through the such element below the nozzle. Arrows C—C indicate that the probe 30*a*" may be moved radially within the section 28" while circular path defined by arrows D—D indicate that the cutting element may be rotated within the wellbore. FIG. 2C shows the position of the cutting element 30" after it has been moved radially a predetermined distance. As is seen in FIG. 2C, the nozzle tip 30*a*" extends beyond the section 28" which will allow the tool 20 to cut a material anywhere below the tool 20.

Electrical circuits and downhole power supplies for operating and controlling the operation of the cutting element 30, the power unit 34, and the devices and sensors placed in section 34 are preferably placed in a common electrical circuit section 38. Electrical connections between the electrical circuit section 38 and other elements are provided through suitable wires and connectors. The surface control unit 70 preferably controls the operation of the cutting system 10.

Figure 3:
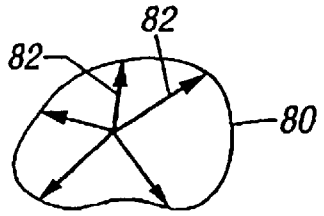
FIG. 3 is an example of a predetermined profile of a section of the casing to be cut that may be stored in a memory associated with the cutting system of FIG. 1.

The operation of the cutting system 10 will now be described with respect to cutting a section or window in a casing while referring to FIGS. 2 and 3. The tool 20 is conveyed downhole and positioned such that the nozzle is adjacent the section to be cut. The stabilizers 40*a–b* are set to ensure minimal radial movement of the tool 20 in the wellbore 22. A cutting profile 80 (FIG. 3) defining the coordinates for the outline of the section to be cut is stored in a memory (not shown) associated with the system 10. Such memory may be in the downhole circuit 36 or in the surface control unit 70. An example of such outline is shown in FIG. 3. The arrows 82 define the vectors associated with the profile 80. The profile 80 is preferably displayed on the monitor 72 at the surface. An operator orients the nozzle tip 30*a* at a location within the section of the casing to be cut. The desired values of the fluid pressure and the pulse rate are input into the surface control unit 70 by a suitable means. The tool 20 is then activated to generate the required pressure and the pulse rate. The fluid to the tool 20 is preferably provided from the surface via the tubing 24. Alternatively, the wellbore fluid may be used.

If the section to be cut is such that it will remain in position after it has been cut, perhaps due to the presence of a cement bond, or if the cut section can be dropped to the wellbore bottom as debris, then the system 10 may be set so that the nozzle tip 30*a* will follow the profile 80, either by manual control by the operator or due to the use of a computer model or program in the system. If the section must be cut into small pieces or cutting so that they may be transported to the surface, the cutting element is moved within the profile at a predetermined speed along a predetermined pattern, such as a matrix. This method ensures that the casing section will be cut into pieces that are small enough to be transported to the surface by circulating a fluid through the wellbore. During operations, the downhole circuits contained in the section 38 communicate with the surface control unit 70 via a two-way telemetry. The downhole telemetry is preferably contained in a section 39.

FIG. 4 shows the downhole cutting tool of FIG. 2 with an imaging device 90 attached below the cutting section 28. Any suitable imaging device may be utilized. The imaging device 90 is utilized to confirm the shape of the section of the casing or the junction after the cutting operation has been performed. The imaging device 90 may also be utilized to image the area to be cut to generate the desired cutting profile and then to confirm the cut profile after the cutting operation. This enables the imaging of a location at a work site of interest and the performance of desired operation at the work site in a preexisting wellbore. Other types of downhole service tools may be utilized for imaging a location in a wellbore at which a tool operation is to be performed and performing the desired tool operation at the work site without retrieving the tool from the wellbore. Certain downhole end work devices are described later.

Figure 5A:
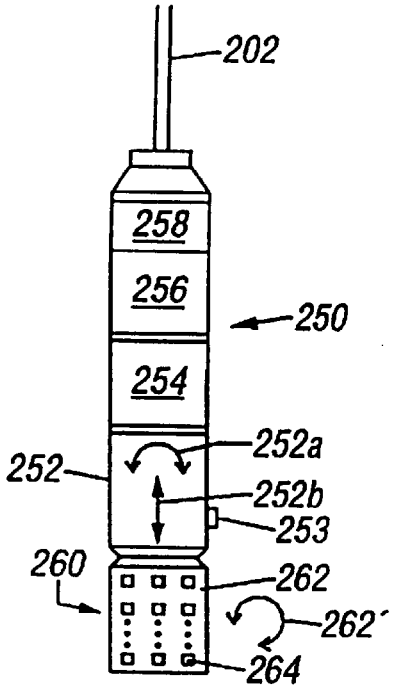
FIG. 5A is a schematic diagram of an embodiment of a downhole (service) tool having an ultrasonic imaging sensor for imaging a work site downhole of the service tool and an end work device for performing a desired operation at the work site during a single trip.
Figure 5B:
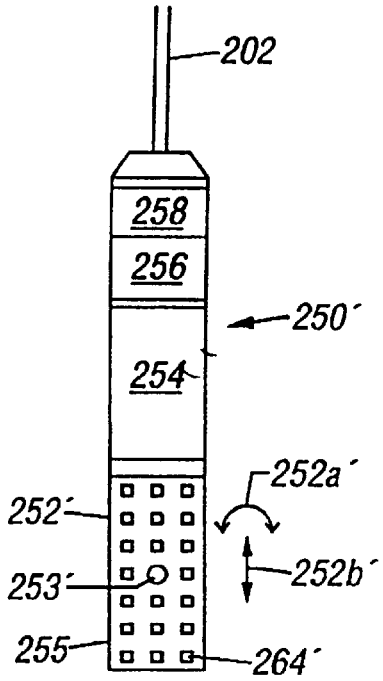
FIG. 5B is a schematic diagram of an alternative embodiment of a downhole tool having an ultrasonic imaging sensor for radially imaging a work site and an end work device for performing a desired operation at the work site during a single trip.
Figure 5C:
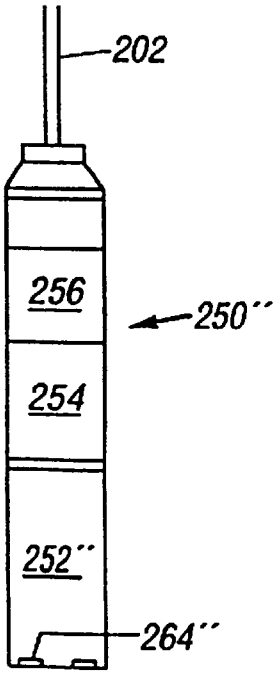
FIG. 5C is a schematic diagram of yet another embodiment of a downhole service tool having an ultrasonic imaging sensor for radially imaging a work site and an end work device for performing a desired operation at the work site during a single trip.

FIGS. 5A–5C show embodiments of downhole ultrasonic imaging devices for use with an end work device to image a work site of interest and to perform a desired operation at the work site during a single trip into the wellbore.

FIG. 5A shows a downhole service tool 250 having an end work device 252 for performing a desired operation downhole, an ultrasonic device 260 (ultrasonic imaging sensor) placed downhole of the end work device 252 for imaging a work site or an object in the wellbore. The imaging device 260 has a number of sensor elements 264 arrange on a body. Each sensor element 264 acts as a transmitter and receiver. The preferred frequency range is between 100 KHz and 500 KHz. The ultrasonic transmitter is preferably adapted to sweep the frequency within a predetermined range of frequencies. The signals transmitted by the sensor element 264 are reflected back from the work site or the object and the reflected signals are received by the sensor elements 264, which are processed by the control unit 256 or circuit in the tool 250 and transmitted uphole via telemetry 258 to provide an image of the work site.

The ultrasonic sensor 260 may be rotated or beam steered (i.e. electrically rotating or directing) to scan the inside of the wellbore. The ultrasonic signals are transmitted at a predetermined rate and the reflected signals are received by the sensor elements 264 between successive firings of the transmitter. The end work device 252 may include a work element 253 that may be rotated by device 254 along the arrows 252*a* to orient the work element radially and may be moved vertically as shown by the arrows 252*b*, i.e., longitudinally to move the work element 253 uphole or downhole, which enables positioning the work element at any desired location in the wellbore. The sensor 260 and the end work device 252 are independently rotatable. The sensor 260 may be disposed above the end work device 252.

As shown in the tool 250' of FIG. 5B, the sensor elements 264' may be arranged on the body 255 of the end work device 252' around the end work element 253'. The sensor elements 264' may be disposed in any desired manner to image a segment of the wellbore or the entire wellbore interior. The tool may be moved along the directions denoted by arrows 252*a*' and 252*b*'. The vertical length of the sensor elements 264' and the spacing there between defines the vertical imaging sweep and the resolution. Similarly, the horizontal distance of the sensor elements 264' and the spacing between the sensor elements defines the radial sweep and the resolution. Alternatively, sensor elements may be arranged on the tool to direct signals downhole, as shown in FIG. 5C here the sensor elements 264" are disposed at the downhole (bottom) end of a service tool 250". This enables the service tool 250" to image an object or a work site downhole of the service tool 250".

Figure 5D:
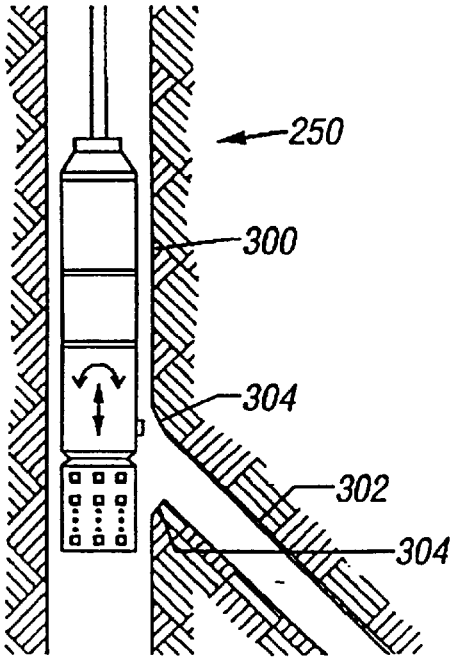
FIG. 5D shows the downhole service tool of FIG. 5A positioned adjacent a wellbore juncture desired work site in a preexisting wellbore.

FIG. 5D shows the downhole service tool 250, shown in FIG. 5A, positioned adjacent to a juncture 304 between a main wellbore 300 and a branch or lateral wellbore 302. The tool 250 may be utilized to image the juncture 304 and perform an operation thereat. The tool 250 provides an image of the juncture 304 to the surface prior to performing an operation. The image may be utilized to position the tool 250 at the desired location and to appropriately orient the tool 250 adjacent the juncture 304. The desired operation may then be performed at the juncture 304, which may include a window cutting operation, reaming operation, cementing, welding, sealing or any other desired operation.

Figure 6A:
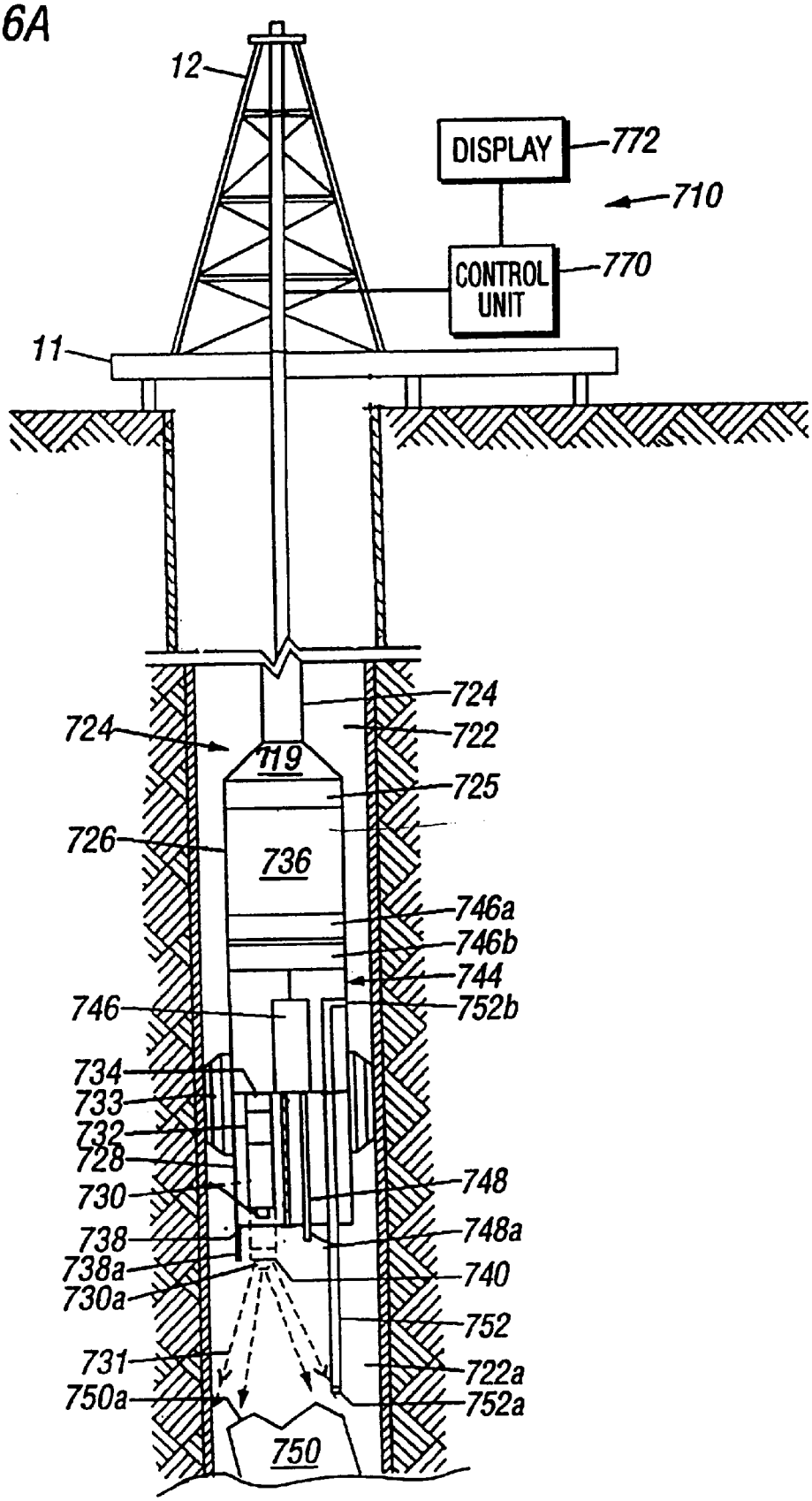
FIG. 6A shows a schematic diagram of an embodiment of an imaging tool for obtaining still and/or video pictures of object downhole.

FIG. 6A shows a schematic diagram of a system 710 for obtaining still and/or video images of a wellbore interior or an object in the wellbore. The system 710 includes a downhole tool 720 that contains a camera for taking pictures of the work site and a mechanism for displacing the non-transparent fluid around the work site with a transparent or substantially transparent fluid. For convenience and ease of explanation and understanding, and not as a limitation system 710 shows only the imaging device, i.e. without any end work device.

The system 710 includes a downhole imaging tool 720 conveyed from a platform 11 of a derrick 12 into a wellbore 122 by a suitable conveying device 124, such as a tubing or wireline. The imaging tool 720 has a tubular housing 726, which is adapted for connection with the conveying device 724 via a suitable connector 719. The housing 726 contains the various elements of imaging tool 720. The bottom section of the housing 726 contains a camera section 728, which houses a retractable camera 730. The camera 730 may be moved within a camera housing 732 by a hydraulic means or an electric means, such as motor, generally denoted herein by numeral 734. The electrical circuits and downhole power supplies for operating and controlling the camera movements are preferably placed in a common electrical circuit section 736. Electrical connections between the camera section 728 and the electrical circuit section 736 are provided through suitable wires and connectors between the two sections. The camera 730 in its retracted position, as shown by the solid lines 730, may be sealed from the outside environment by closing a hatch or door 738. The hatch may be adapted to open outward as shown by the dotted line 738*a* or by a sliding door (not shown). In the fully retracted position, the camera 730 resides completely inside the housing 728 so that the hatch 738 may be closed to seal the camera 730 from the outside environment.

Figure 6B:
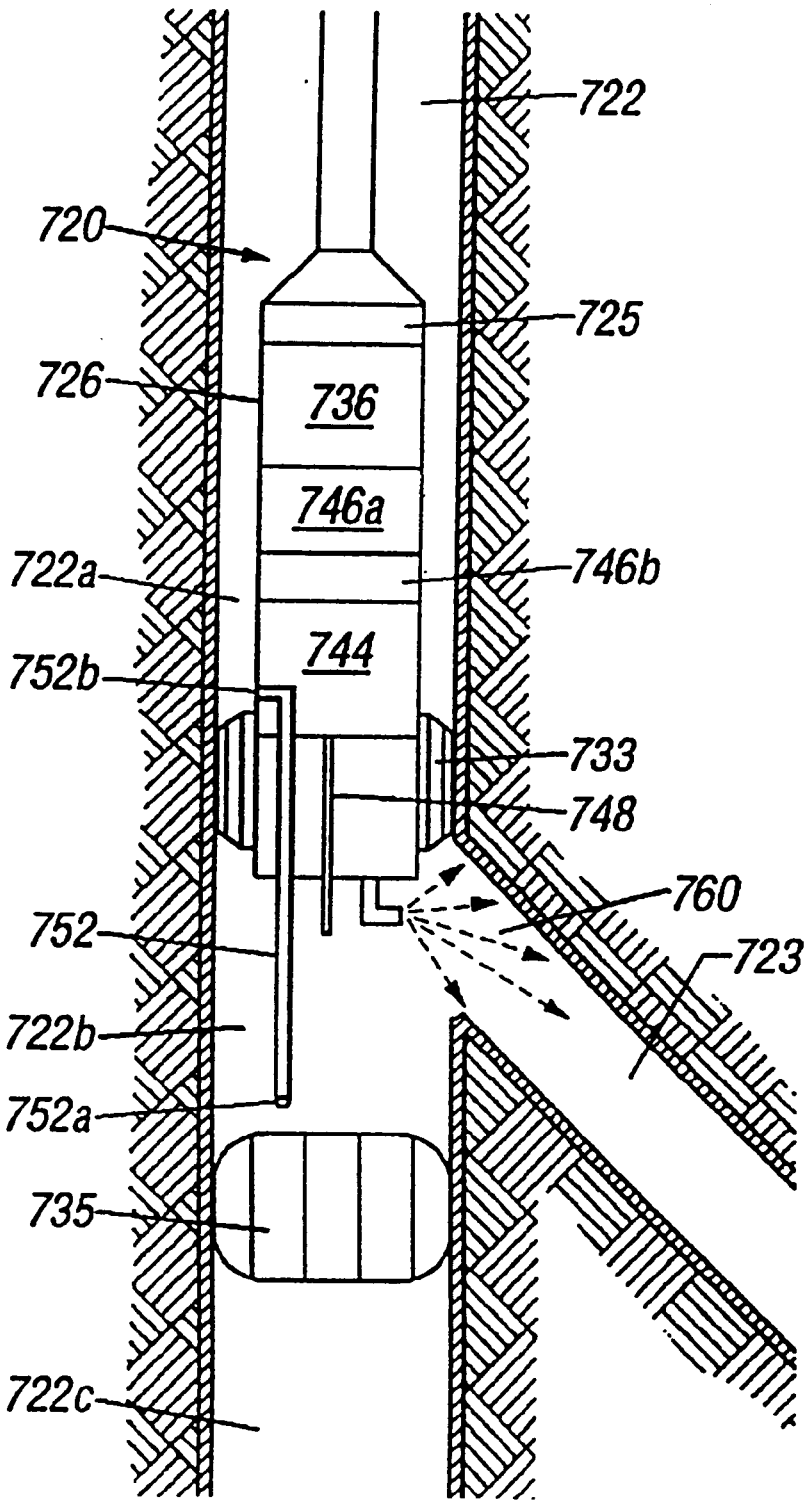
FIG. 6B shows a schematic diagram of the imaging tool of FIG. 5D positioned adjacent to a juncture between a main wellbore and a branch wellbore.

In the fully extended position, the camera 730 extends far enough from the camera section 728 or any other obstruction, as shown by the dotted line 730*a*, so that the camera 730 can be rotated 360 degrees and can take unobstructed pictures of its surroundings. A light source 740 attached near the camera provides sufficient light for the camera to obtain pictures downhole. Additional light sources (not shown) may be provided on the tool body 726 to provide light in all the directions. The camera 730 may be focused downward as shown in FIG. 6A or horizontally as shown in FIG. 6B or along any other desired direction depending upon the intended application.

The imaging tool 720 contains a fluid injection section 744 for injecting a substantially transparent fluid (herein referred to as the clear fluid) into the wellbore. The fluid injection section 744 is preferably placed above (uphole) the camera section 728. The fluid injection section 744 includes one or more chambers, such as 746*a* and 746*b*, for storing therein the clear fluid. A pump 746 in the section 744 is used to controllably inject the clear fluid from the chambers 746*a*–746*b* into the wellbore below the camera section 728 via a fluid line 748. The fluid line 748 runs from the fluid injection section 744 through the camera section 728 to an outlet point 748*a* below the camera section 728. Any downhole electrical control circuits and related power supplies for operating the pump 746 are preferably housed in the electrical section 736.

A surface control unit 770 placed at a suitable location on the rig platform 711 preferably controls the operation of the imaging system 710. The control unit 770 includes a suitable computer, associated memory, a recorder for recording data and a display or monitor 772. The operation of control units, such as the control unit 770, is known and is, thus, not described in detail herein.

The operation of the imaging system 710 will now be described in reference to obtaining an image of an object, such as object 750, stuck in the wellbore 722. To obtain the image of the object 750, the location of the object is first determined. A number of techniques have been utilized in the oilfield applications for determining the location of an object or work site in a wellbore. Any such technique or method may be utilized for determining the location of the object 750 for the purposes of this invention. The tool 720 is then conveyed into the wellbore 722 until the bottom end 752*a* of the fluid return pipe 752 is below the surface 750*a* of the object 750 that is to be imaged. The packer 733 is then inflated or set in the wellbore 722 to seal the wellbore section 722*a* below the camera section 728 from the wellbore section 722*b* above the packer 733. The pump 746 is then activated from the surface control unit 770 to inject the clear fluid from the chambers 746*a*–*b* into the wellbore section 722*a* via fluid line 748. The injection of the clear fluid into the section 722*a* causes the wellbore fluid present in the section 722*a* to enter the fluid pipe 752, which fluid is discharged into the wellbore section 722*b* above the packer 733 via a port 752*b*. This processes is continued until the wellbore fluid between the port 752*a* and the camera section 728 has been replaced with the clear fluid. The clear fluid chosen is preferably lighter than the wellbore fluid and will not mix with the wellbore fluid. Such a clear fluid when injected into the wellbore section 722*a* will uniformly displace the wellbore fluid. In some applications, it may be necessary to continue to inject additional clear fluid so as to completely flush out the wellbore fluid from section 722*a*. The system of the present invention may employ a clear fluid source at the surface (not shown) instead of downhole chambers. In this embodiment, the clear fluid is continuously supplied to the chamber 746 from a surface source via a line placed in the conveying means 724. Such a system may be necessary when large quantities of clear fluid are required to flush out the wellbore fluid.

After the object 750 has been exposed to the clear fluid, the camera door 738 is opened and the camera 730 is lowered to its fully extended position 730*a*. To obtain the images of the object 750, the camera lights 740 are activated, the camera 730 is oriented in a desired position and the camera is operated to obtain images of the object 750. The images from the camera are transmitted by the downhole control circuits in section 736 to the surface control unit 770 via a two-way telemetry 725. The images are displayed on the monitor 772. The operator can orient the camera in any desired direction and continue to obtain images. If a video camera is used, the motion pictures are displayed on the monitor. The images are recorded in the recorder associated with the surface control unit 770.

FIG. 6B shows the application of the imaging system 710 described above in reference to FIG. 5D for obtaining images of a junction 760 between a main wellbore 722 and a branch wellbore 723. To obtain images of the junction 760, a packer 735 is first set in the wellbore 722 below the junction 760 to completely seal off the wellbore section 22*c* lying below the packer 35. The imaging tool 720 is then conveyed in the wellbore 722 so that the packer 33 is completely above the junction 760 while the port 752*a* of the fluid return line 752 is below the junction 760. The imaging tool 720 is operated as described earlier to displace the wellbore fluid in the wellbore section 722*a*' between the packers 733 and 735 with the clear fluid. The camera 730 is then oriented in the direction of the junction 760 to obtain the desired images. Images of other objects in the wellbore and any section of the wellbore may be obtained by the imaging system 710 in the above-described manner.

Figure 6C:
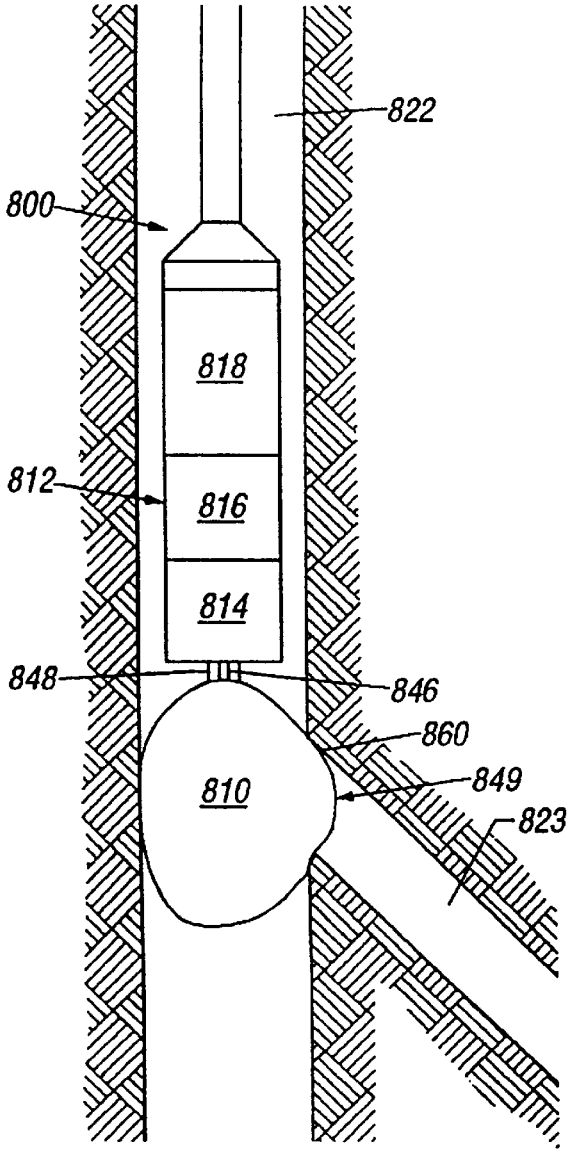
FIG. 6C shows a schematic diagram of an inflatable imaging tool position at a wellbore juncture for determining a contour of the juncture.

FIG. 6C shows another embodiment of a downhole imaging tool 800. The imaging tool 800 includes a flexible inflatable device 810 at a lower end of the tool 800. A fluid injection system 812 in the tool 800 injects a fluid into the device 810, thereby inflating the device 810. The fluid injection system 812 preferably contains a fluid pump section 814 having a reversible pump therein for injecting or pumping a fluid from a chamber 816 into the device 810 and vice versa.

Figure 6D:
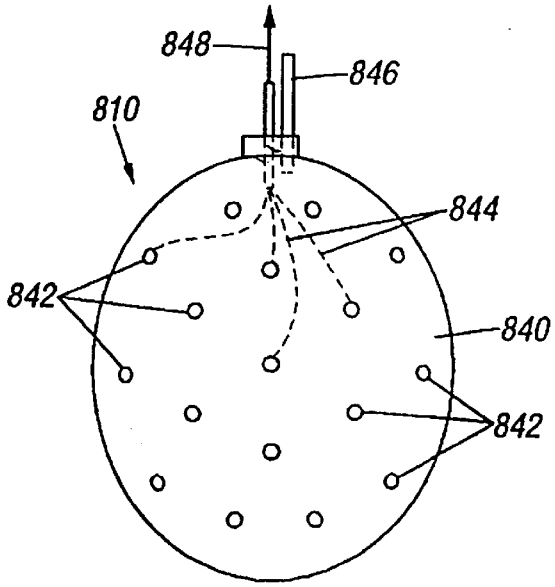
FIG. 6D shows a configuration of the placement of sensors in the inflatable member used in the imaging tool of FIG. 5F.

FIG. 6D shows a cross section of the flexible inflatable device 810. It includes a bladder 840 made from a flexible material, such as rubber. A plurality of sensors 842 are arranged along the inner surface 840*a* of the bladder 840 in a matrix or grid as shown in FIG. 6D. Each such sensor provides a signal corresponding to the deformation of the bladder surface to which the sensor is attached from a predetermined norm. The signals from each such sensor are transmitted to a downhole control circuit 816 via a conductor 844 and communication link 848. Fluid line 846 provides access to the bladder inside 840*a*. The downhole control circuit 816 controls the operation of the pump section 812, receives data or signals from the each of the sensors 842, conditions the signals and may manipulate the signals to obtain an image. The downhole control circuit 816 may transmit the conditioned signals to a surface control unit, such as unit 970 shown in FIG. 17, which produces the image based on a model stored in the control unit. The model is predetermined or predefined based on the geometry of the flexible member 810 and the configuration of the sensors 842. The model is stored in a downhole memory associated with the downhole control circuit 816 when the system is designed to compute the model downhole.

Operation of the tool 800 will now be described in the context of obtaining an image of a junction between the main wellbore 822 and the branch wellbore 823. To obtain an image of the junction 860, the tool 800 is conveyed into the main wellbore 822 until the flexible member is adjacent to the junction 860. The fluid from the fluid section 812 is then injected into the flexible member 810, thereby inflating the member 810. A portion of the flexible member at the junction 860 attains the shape that corresponds to the junction 860 outline. The downhole control circuit 816 measures the signals from each of the sensors 842 and processes such signals as described above to obtain the image of the junction. Image of an object in the wellbore, such as object 850 shown in FIG. 6B, is obtained by inflating the flexible member 810 while urging it against the object.

FIGS. 7–16 show embodiments of certain downhole tools which are adapted to image a work site of interest and perform a desired operation at work sites in a pre-existing wellbores during a single trip according to the present invention.

Figure 7:
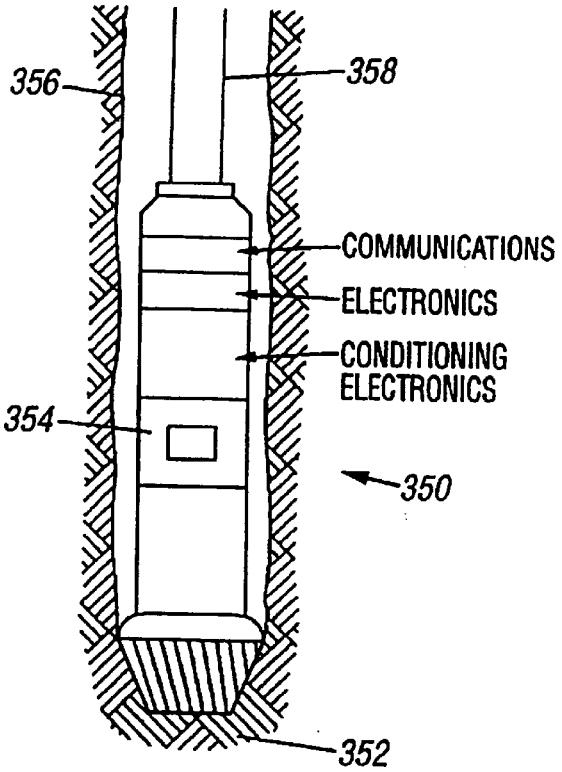
FIG. 7 is a schematic diagram of an embodiment of a downhole tool having an imaging device and a milling tool disposed at a bottom end of the tool for imaging a work site and performing a milling or cutting operation at the work site during a single trip.

FIG. 7 shows an embodiment of a downhole service tool 350 conveyable by a tubular member 356, such as a drill pipe. The end work device 352 is a milling device and is disposed at the bottom end of the conveying member 356. A suitable imaging device 354 is disposed above the milling device 352. A conduit 358 may be utilized to supply hydraulic or electric power to the tool 350. A control unit, other sensors, and associated electronic circuitry and telemetry may be disposed in the tool 350 as described earlier. During operation, the work site or the object to be milled is imaged by the imaging sensor 354 and the cutting operation is performed by the milling device 352. Images of the area being cut are periodically obtained to ensure that the cutting operation is being performed correctly. Other end work devices, such as tools for determining the widow seal integrity may be disposed with the milling device 352.

Figure 8A:
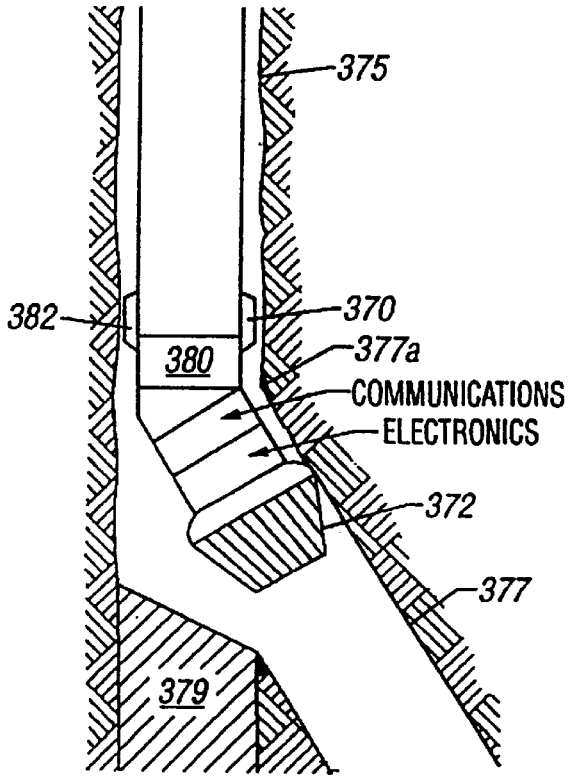
FIG. 8A is a schematic diagram of an embodiment of a downhole tool having an imaging device and an end work device for use in lateral wellbore operations.

FIG. 8A shows a downhole service tool 370 that may be utilized to image a location in the wellbore 375 and then drill the lateral wellbore 377 and/or to facilitate re-entry of an end work device into the lateral wellbore 377. To drill the lateral wellbore 377, the tool 370 is positioned above a whipstock or any other suitable re-entry device 379. An image device 380 provides images of the location where the lateral wellbore 377 will be drilled, which image may be utilized to position and orient the drilling element (bit) 372. Alternatively, since the image is available, the operator can set kick-off devices 382 to cause the device 372 to perform an operation at a juncture 377*a* without first requiring the installation of the re-entry device 379, thereby avoiding another trip downhole. The tool 370 may similarly be used to reenter the wellbore 377 to perform secondary operations in the branch wellbore 377, thereby eliminating an extra trip to install the re-entry device 379.

Figure 8B:
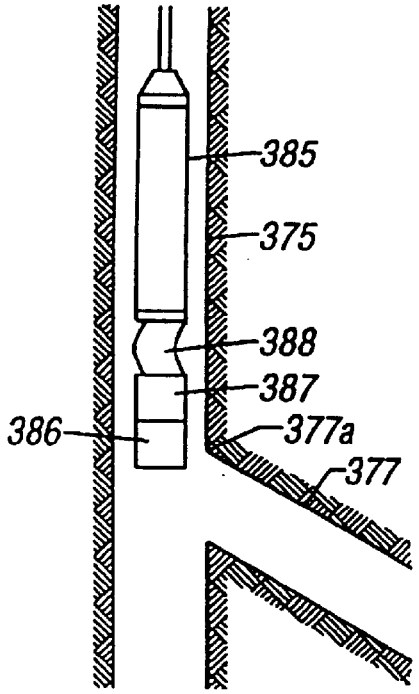
FIGS. 8B–8D are schematic diagrams of downhole tools with an imaging device and re entry device.
Figure 8C:
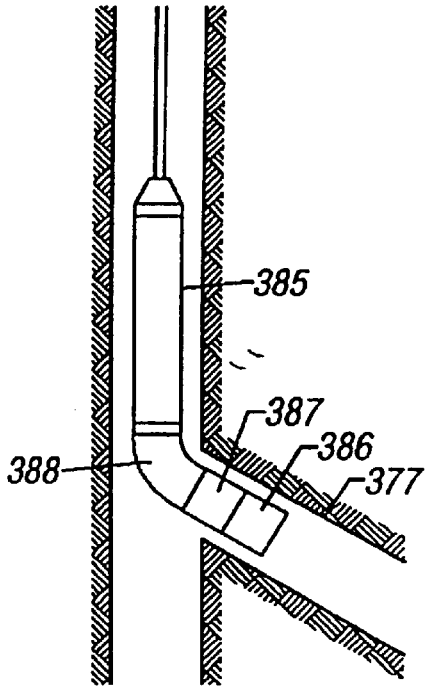

FIGS. 8B and 8C show another embodiment of a downhole service tool 385 which can be utilized to enter a branch wellbore 377 from a main wellbore 375 without the use of a re-entry device, such as a whipstock or a diverter. The downhole service tool 385 includes an end work device 386 at the service tool 385 downhole end, a suitable imaging device 387 and a downhole operated tool orientation device 388. The device 388 preferably is a hydraulically or electrically operated knuckle-type joint which bends the tool 385 portions above and below the device 388 up to a predetermined maximum angle. The service tool 388 is lowered into the main wellbore 375 to a known distance above the juncture 377*a*. The image device 387 provides images of the juncture 377*a*. The operator then orients the tool 385 and activates the device 388 to bend the tool 385 at a predetermined angle. The device is locked into the bent position and the tool 385 continues to be lowered into the wellbore. Inserting the tool 385 further causes it to enter into the branch wellbore 377 as shown in FIG. 8C.

Once the bottom end device 386 has entered into the branch wellbore 377, the device 388 is unlocked, which allows the front portion of the tool 385 to straighten as it moves further into the branch wellbore 377. After the tool 385 has been conveyed to the desired work site in the branch wellbore 377, the end work device 386 is then utilized to perform the desired operation. Thus, the service tool configuration of FIGS. 8B–8C allows the operator to (a) convey the service tool 385 into a branch or lateral wellbore 377 without the use of a secondary device, such as a diverter, and (b) image a desired work site in the branch wellbore and perform a desired operation at the work site in a single trip. This service tool 385 can eliminate two downhole trips, one to install a diverter, such as the diverter 379 shown in FIG. 8 and a second trip to image the work site prior to performing the work at the work site.

Figure 8D:
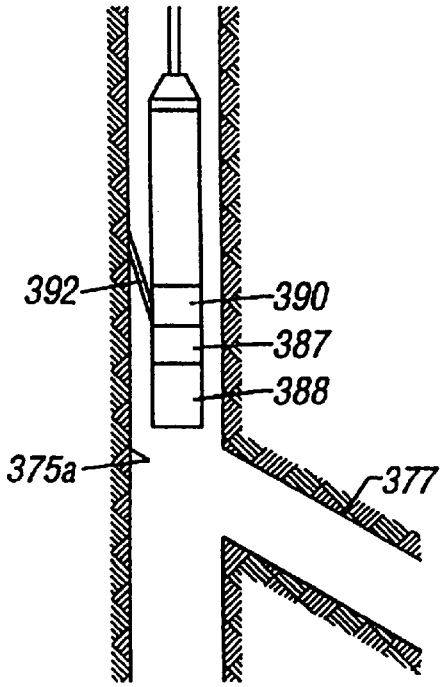

FIG. 8D shows an alternative device 390 for causing the service tool 385 to enter the branch wellbore without the use of a diverter. The device 390 includes a plurality of arms or members which can be independently extended outward from the service tool body to urge against the wellbore wall 375*a*. Selectively urging the members 392 against the wellbore wall 375*a* causes the tool to enter the branch wellbore 377.

The knuckle-joint 388 shown in FIG. 8B and the arm members 392 shown in FIG. 8D are operated by their respective control units in the service tool 385. The downhole control unit (FIG. 1) controls the operation of these devices based on instructions provided from the surface control unit 70 or downhole stored programmed instructions. The service tool may also be programmed to locate the juncture 377*a* and cause the tool 385 to enter the branch wellbore 377. Thus, the service tool shown in FIGS. 8B–8C can locate a lateral or multilateral juncture, adjust or orient itself and penetrate the lateral wellbore without the use of additional devices, such as diverters and whipstocks, and thereafter perform an end work in the lateral wellbore during a single trip downhole.

Figure 9:
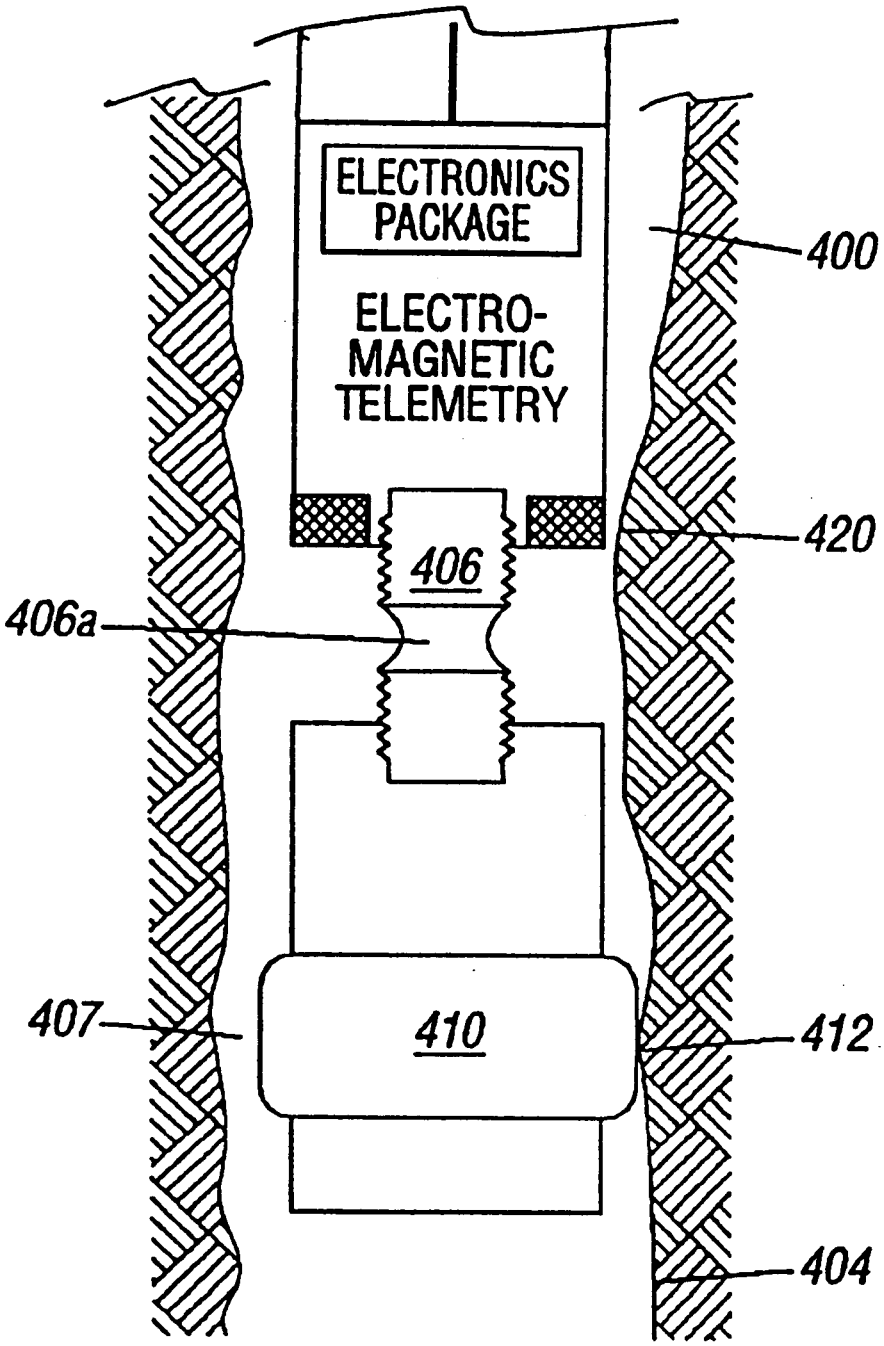
FIG. 9 is a schematic diagram of an embodiment of a downhole tool having an imaging device and an inflatable packer wherein the imaging device is adapted to obtain images during setting of the inflatable packer in a wellbore.

FIG. 9 shows an embodiment of a service tool 400 with an imaging device 420 and a packer 410 as the end work device. The service tool 400 is shown conveyed by a tubular 402 into an open hole 404. The packer 410 has an inflatable packer element 412, which when inflated seals an annulus between the packer 410 and the wellbore 404. The packer 410 is attached to the tubular 402 by a shear bolt 406 having a weak point 406*a* that may be sheared to separate the packer 410 from the tubular 402. An imaging device 420 for imaging the annulus 407 between the packer 410 and the wellbore 404 is placed above the shear point 406*a*.

To set the packer element 412 in the annulus 407, the tool 400 is positioned in the wellbore 404 so that the packer 410 is across from the area 407. The packer 410 is set by injecting a hardening fluid, such as cement, epoxy, or another suitable material, into the packer element 412. If an acoustic device is used as the imaging device, its response characteristics are a function of the manner the annulus is being enclosed with the hardening material. The data from the imaging device 420 is analyzed to determine the quality of the bond between the packer element 412 and the formation 404. Based on the imaging characteristics, the amount of the hardening material being supplied to the packer element 412 can be adjusted to improve the integrity of the seal. After the packer 410 has been set, the bolt 406 is sheared to retrieve the service tool 400 from the wellbore 404.

Figure 10A:
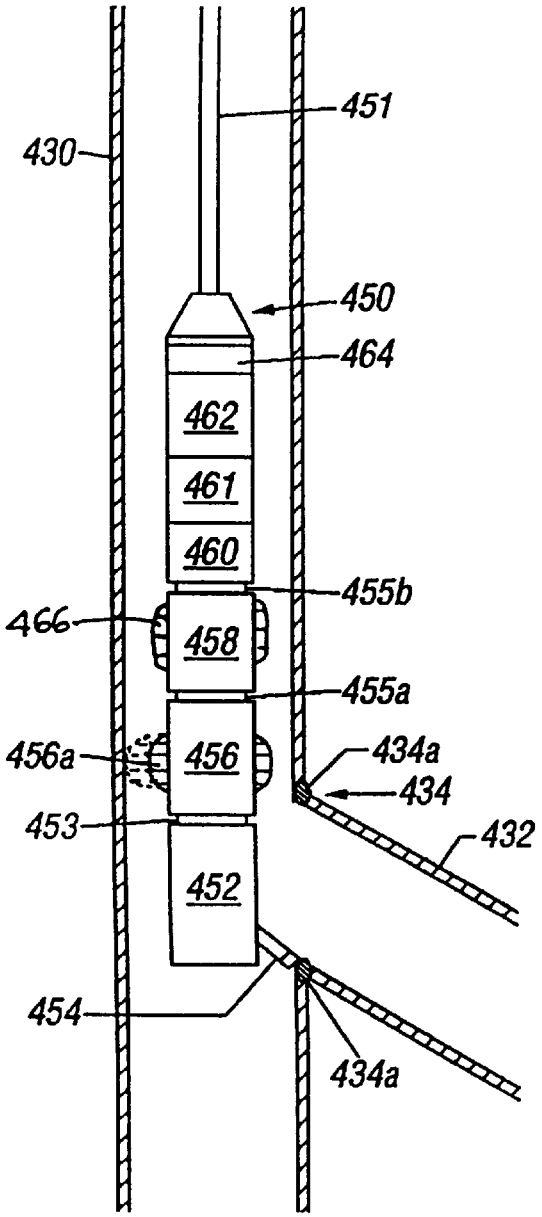
FIGS. 10A–10B are schematic diagrams of an embodiment of a downhole service tool having an imaging device and a welding device disposed for imaging a work site and performing a welding operation at the work site.
Figure 10B:
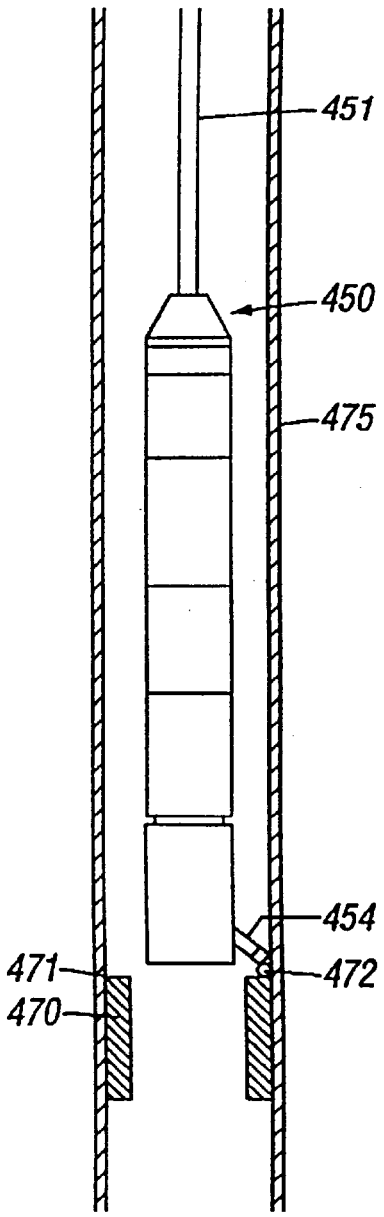

FIGS. 10A and 10B show examples of embodiments of downhole service tools for imaging a work site of interest and performing welding operations at the work site during a single trip in the wellbore. FIG. 10A shows the service tool 450 for welding a juncture 434 between a casing 430 in a main wellbore 435 and a casing 432 in a branch or lateral wellbore 437. The service tool 450 includes a welding device 452 at its bottomhole end. The service tool 450 may also include a milling device 456 to dress or smooth any rough welding performed by the welding device 452. An image device 458 is preferably placed above the welding device 452 and the milling device 456. The welding device 452 is coupled in the tool 450 with a rotatable joint 453. Similarly, if a milling device 456 is utilized, it is preferably disposed in the service tool 450 via rotatable joints 455*a* and 455*b*. The rotatable joints 453, and 455*a* and 455*b* allow the welding device 452 and the milling device 456 to independently rotate in the wellbore 435. The service tool 450 also includes a control unit 461 to position and orient the tool 450 in the casing 430 and other desired devices 462. A central processor 460 processes signals and data from the downhole devices and communicates with the surface computer 70 (FIG. 1) via a two-way telemetry 464.

To weld the casings 430 and 432 at the juncture 434, the service tool 450 is conveyed into the casing 430 by a suitable conveying system 451. The imaging device 456 provides an image of the juncture 434 to the surface control unit 70 (FIG. 1). The welding device 452 is positioned adjacent to the juncture 434. The welding tip or probe 454, having its own degrees of freedom, is positioned at the juncture to perform the welding operation. The probe 454 may be extended radially and/or axially to position the probe 454 at any desired location in the casing 430. The axial movement of the service tool 450, rotary movement of the joint 453 and the axial and radial movements of the probe 454 provide necessary degrees of freedom of movement to position the welding probe 454 at any desired spot in the casing 430. One or more downhole-controlled and independently-operated stabilizers or radially extendable arms 466 or any other suitable device may be utilized to urge the probe 454 against the juncture 434 to be welded.

The image device 456 may be utilized to image the juncture 434 after welding operations or intermittently during welding operations to ensure quality and integrity of the welds 434*a*. The tool 450 may then be repositioned to place the milling device 456 adjacent to the weld 434*a*. The milling device 456 has a milling surface 456*a* on its outside, which is extended outwardly and urged against the weld 434*a* to smooth out the weld 434*a*. Any suitable milling device, including any commercially available mechanical milling device may be utilized in the service tool 450.

FIG. 10B shows a manner of utilizing the service tool 450 for welding a device 470, such as a permanent packer, a plug, or a plate below the plate inside a casing 475. To weld the device 470 inside the casing 475, the service tool 450 is placed above the device 470 to image the work site 471 to be welded. The tool 450 is then repositioned to place the welding probe 454 against the area 471. The welding operation is then performed in the manner described above. It should be noted that only one type of welding device has been described above to perform selected welding operations to describe the concept of the invention. Any other suitable welding device may be utilized with the service tool 450 to perform any type of welding operations.

Figure 11:
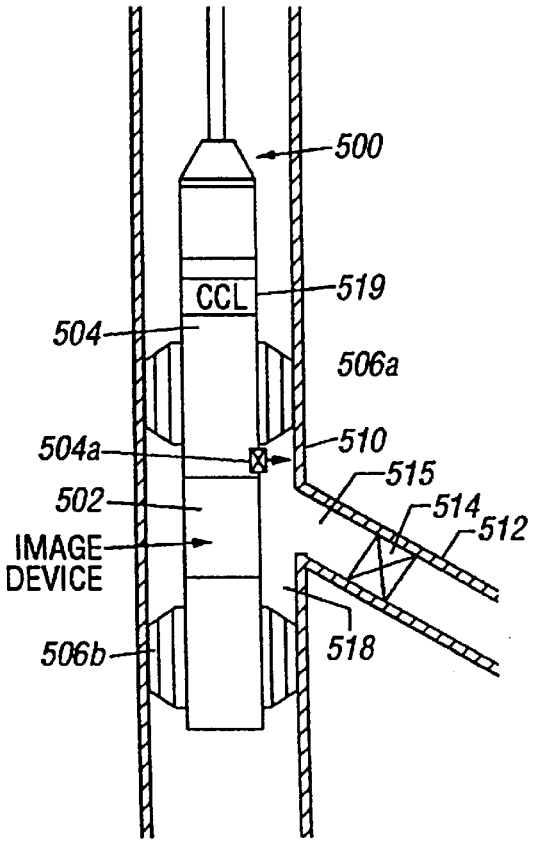
FIG. 11 is a schematic diagram of an embodiment of a downhole tool having an imaging device and an end work device for pressure testing the integrity of a juncture.
Figure 12:
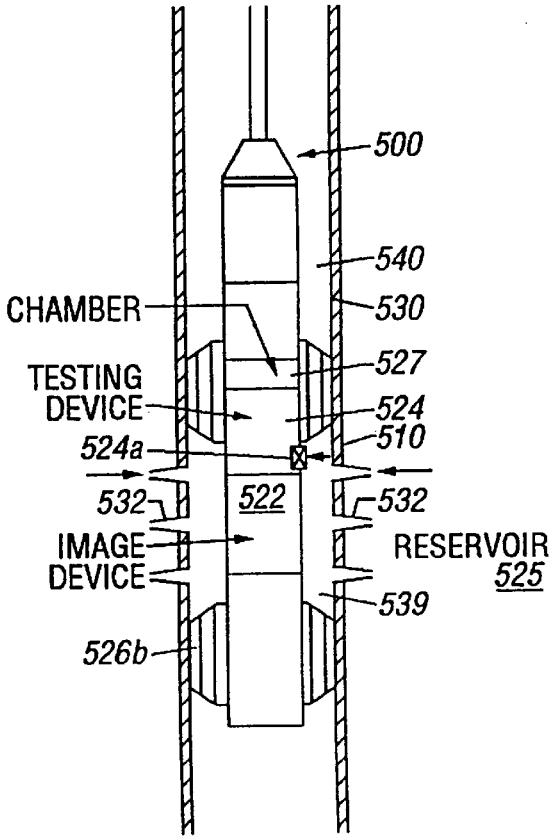
FIG. 12 is a schematic diagram of an embodiment of a downhole tool for performing testing of a perforated zone.

FIGS. 11 and 12 show a service tool 500 for performing testing operations in the wellbore. FIG. 11 shows a configuration for testing the integrity of a seal. In the example of FIG. 11, a seal 514 is placed in a lateral wellbore 512 formed from a main wellbore 510. The service tool 500 is shown conveyed into the main wellbore 510. It includes a suitable imaging device 502, a device 504 for discharging a high pressure fluid into the wellbore 510 and a pair of packers 506*a* and 506*b* spaced apart on the service tool 500 to seal a zone of interest 518 in the wellbore 510. To test the integrity of the seal 514, the service tool 500 is positioned adjacent to a juncture 515 to provide an image of the juncture 515, which image is utilized to position the tool 500 such that the upper packer 506*a* is above the juncture 515 and the lower packer 506*b* is below the juncture 515. The packers 506*a*–506*b* are then set as shown in FIG. 11 to seal the space 518 enclosed by the seal 514, the upper packer 506*a* and the lower packer 506*b*. Pressurized fluid is then discharged from the device 504 into the space 518 via openings 504*a*. The pressure drop, if any, in the space 518 is measured over a predetermined time period, which provides an indication of the seal integrity.

FIG. 12 shows a configuration of a service tool 520 for use in testing a production zone or reservoir 525. This configuration is substantially similar to the tool configuration shown in FIG. 11. FIG. 12 shows a cased hole 540 having a production zone 539. The casing 530 has a plurality of perforations 532 through which fluids from the reservoir 525 enter into the casing 530 at zone 539. Periodic testing of production zones is commonly performed during the life of such production zones to determine the fluid flow from each zone or a portion thereof, to build and update reservoir models and to estimate the future production from such reservoirs. To test a production zone, such as zone 539, the tool 520 images the perforated zone 542 (work site). The image is utilized, among other things, to position the tool 520 adjacent to the perforations 532. The packers 526*a* and 526*b* are set in the casing 530 to seal the zone 539 between the packers 526*a*–526*b*. A testing device 524 is then utilized to perform desired testing. The testing device 524 shown has a flow control valve 524*a* to control the fluid flow from the reservoir into the tool 530. The received fluid may be collected in chambers 527 for further analysis or discharged into the wellbore uphole of the upper packer 526*a*. The testing device 524 also may include temperature sensors, pressure sensors and may include devices to determine chemical and/or physical properties of the fluids, including specific gravity, oil, gas and water content in the formation fluid. To determine pressure and temperature build up, commonly performed for reservoir modeling, the valve 524 is closed and required measurements are made over a predetermined time period. Any other type of testing device may also be employed in addition to or as an alternative to the device 424. The image obtained of the perforated zone 539 allows an operator to position the tool 530 precisely adjacent to the desired perforations 532. The packers 526*a* and 526*b* may be made slidable over the tool 530 so that the length of the zone 539 may be adjusted downhole.

It will be obvious that FIGS. 11 and 12 show specific examples in which the service tool of the present invention can be utilized to image a work site in a wellbore and then perform testing (end work) during a single trip in the wellbore. Any other suitable testing device may be utilized for the purposes of this invention.

Figure 13:
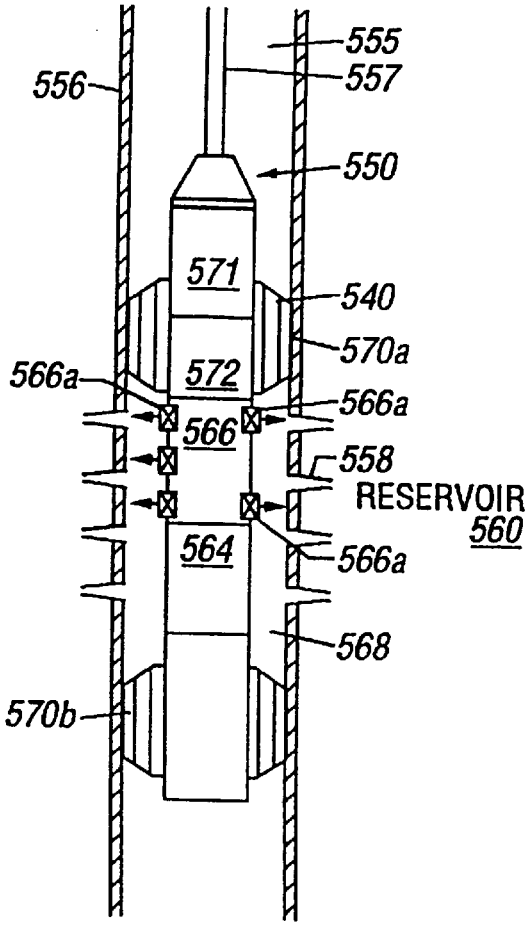
FIG. 13 is a schematic diagram of an embodiment of a downhole tool having an imaging device and an end work device for performing rework operations in wellbores.
Figure 14:
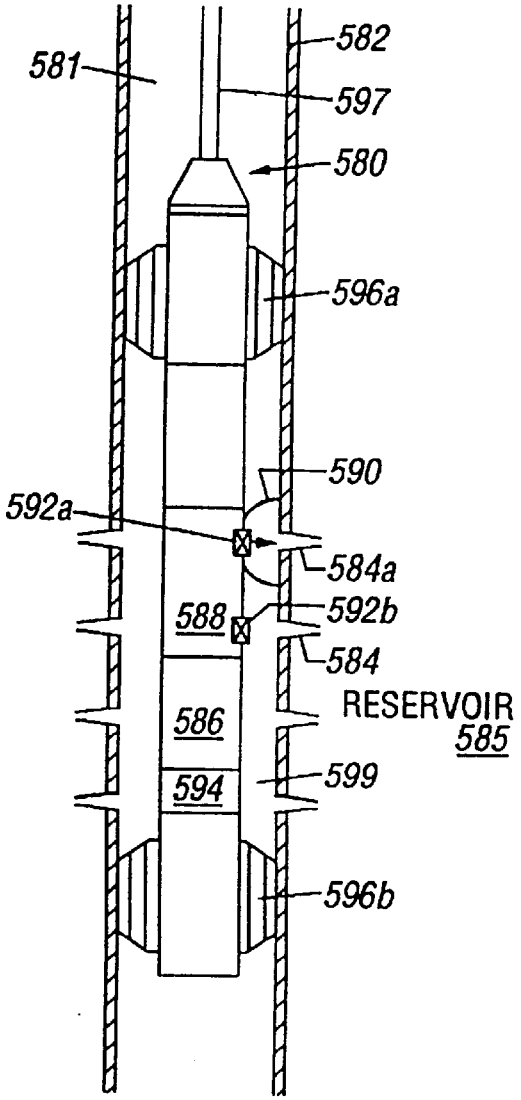
FIG. 14 is a schematic diagram of an alternative embodiment of a downhole tool according to the present invention for performing cementing, fracturing and squeeze-off operations in wellbores.

FIGS. 13 and 14 show examples of the service tool of the present invention for performing remedial work in preexisting wellbores. FIG. 13 shows the service tool 550 conveyed in a cased wellbore 555 lined with a casing 556. The casing 556 has a plurality of perforations 558 adjacent to a reservoir 560. The service tool 550 includes a suitable image device 564 and a device or unit 566 for injecting fluids under pressure into the wellbore 555. The remedial work in the wellbore 555 may include injecting a fluid (water, sand, glass, chemicals or mixture of water and additives, etc.) under pressure through the perforations 558 to increase the flow of formation fluids from the reservoir 560 into the wellbore 555. To perform such a remedial work, the service tool 550 is positioned in the wellbore 555 to obtain images of the perforated zone 568. The images are utilized to reposition the tool, if necessary. Packers 570*a* and 570*b* are set in place to isolate the desired zone of interest or the work site 568. The desired fluid is then injected into the zone 568 by the device 566 via control valves 566*a*. The desired fluid may be injected via tubing 557 from the surface. The flow from each of the control valves 566*a* is preferably independently controlled by a downhole control unit 571. The above-described system is equally applicable for open hole fracturing applications.

The service tool 550 shown in FIG. 13 may also contain a test device, such as the test device 572, similar to the test device 534 shown in FIG. 11 to perform testing of the zone 568 to determine the effectiveness of the work performed. The service tool 550 shown in FIG. 13 thus may be utilized to image a work site (production zone 568), perform a work (remedial work) at the work site, and then determine the effectiveness of the work performed during a single trip in the wellbore.

During the life of a wellbore, it is sometimes desired or even required to seal off a production zone or a portion thereof for reasons such as the zone is producing excessive amounts of water and is impeding the flow of hydrocarbons from other production zones in the same wellbore. FIG. 14 shows a configuration of a service tool 580 of the present invention for sealing a production zone 599 or a portion thereof by cementing the zone 599 and then confirming the integrity of the seal. FIG. 14 shows a service tool 580 conveyed in a cased wellbore 581 lined with a casing 582. The casing 582 has a plurality of perforations 584 adjacent to a reservoir 585. The service tool 580 includes a suitable image device 586 and a device or unit 588 for injecting cement slurry under pressure into the wellbore 581. The remedial work in the wellbore 581 may include closing off a single perforation 584*a* or the zone 599 having a number of perforations 584. To close off the zone 599, the tool 580 is positioned in the wellbore 581 to obtain images of the perforated zone 599. The images are utilized to reposition the tool 580, if necessary, and packers 596*a* and 596*b* are set in place to isolate the desired zone of interest or the work site of interest 599. The cement is then injected from the cement device 588 into the zone 599 via a control valve 592*b* to seal the intended zone 599. The tool 580 is then retrieved. To cement a single perforation, such as perforation 584*a*, a flexible cup 590 on the outside of the tool 580 is urged against the perforation 584*a*. Cement or any other desired fluid is then controllably discharged from an opening 592*a* to close the perforation 584*a*. The tool 580 may also include a testing device 594 to test the integrity of cementing work. The device 594 may be a flow measuring device to determine if any fluid is flowing out of the cemented zone. Pressure and temperature measuring devices and resistivity measuring devices may also be utilized as test devices.

Additionally, the image device 586 may be utilized to obtain secondary images of the cemented work site to determine the effectiveness of the work performed. It should be noted that the term cement is used to generally mean hardening materials, including cement slurry, epoxies and any other suitable material. In some cases, it is desirable to intentionally damage a formation or zone to seal unwanted production of formation fluids. The above-described method may also be utilized for such applications.

Figure 15:
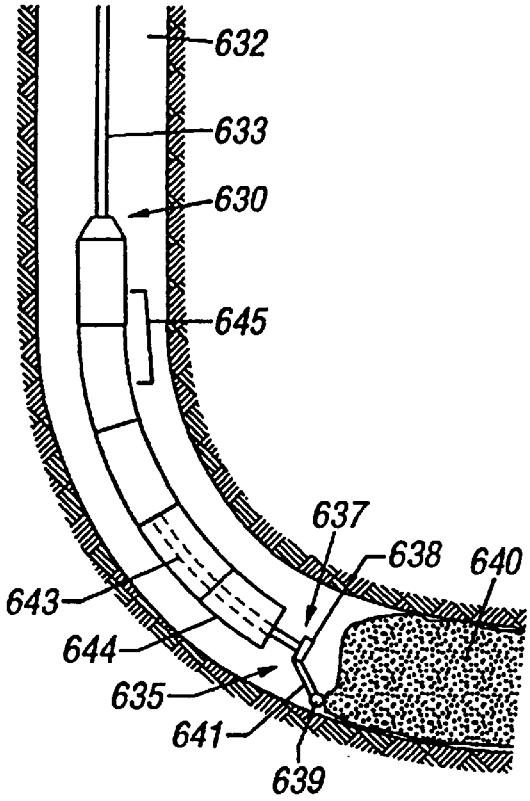
FIGS. 15–16 are schematic diagrams of embodiments of a downhole tool for performing fishing operations in wellbores.
Figure 16:
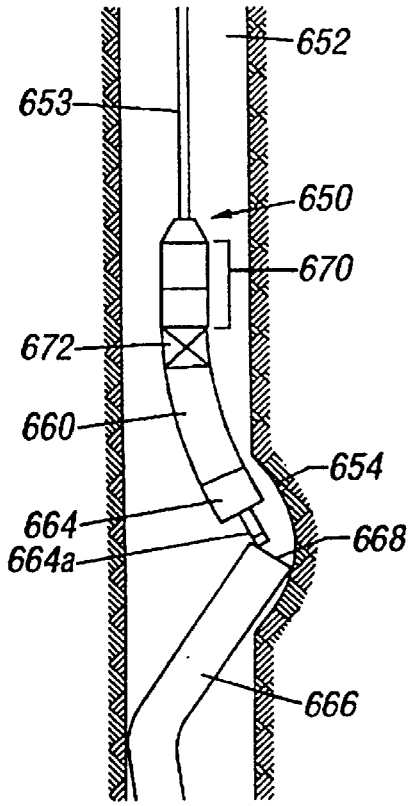

FIGS. 15 and 16 show examples of service tools of the present invention for performing fishing operations preexisting wellbores. FIG. 15 shows a service tool 630 conveyed in a wellbore 632 by a tubing 633. The service tool 630 includes a suitable image device 635 having a retractable tactile sensor for imaging an object, such as a fish 640 stuck in the wellbore 632. The tactile image device 635 includes a retractable probe 637, which has a tip 639 that can scan the entire inside of the wellbore 632. The probe tip 639 attached to an arm 641 which can move radially and axially around a rotary joint 638. The joint 638 can move axially as shown by the dotted lines 643, thereby providing sufficient numbers of degrees of freedom to the probe tip 639 to scan the wellbore 632. The service tool 630 includes a suitable fishing device for engaging the fish 640 and other devices, sensors, control circuits and telemetry, collectively designated by numeral 645. To retrieve the fish 640 from the wellbore 632, the service tool 630 is positioned above the fish 640. The imaging device 635 senses the location and profile of the fish 640, which is communicated to the surface. The tool 630 is then repositioned, the fishing device 644 is activated to engage the fish 640. Any other suitable imaging device may be utilized for imaging the fish 640. Also any suitable fishing device may be utilized for the purpose of this invention. For example, the fishing device may be the type that grabs the fish from the outside or the inside of the fish 640. It may be a spear type or an over-shot type device as described in U.S. Pat. No. 5,242,201, which is incorporated herein by reference. The fishing tool 635 may drill into the fish 640 to securely engage the fish 640. The fish 640 is retrieved by retrieving the tool 630. It should be obvious that the tactile imaging device 635 may include more than one probes and that such imaging devices may be utilized in any of the service tools made according to this invention.

FIG. 16 shows the use of a service tool 650 conveyed in a wellbore 652 by a tubing 653. The service tool 650 includes a suitable imaging device 660, including an ultrasonic and tactile device. In the example of FIG. 16 a fish 666 is shown stuck in a wash-out area 654 of the wellbore 652. To retrieve the fish 666, the tool 650 is positioned adjacent to the fish 666 to image the 666 fish by the imaging device 660. The tool 650 may include a one or more knuckle devices 672 that can be activated from the surface or downhole control circuits 670 to position the image device 660 and a fishing device 664 in the wash-out region 654. After the image is taken, the fishing device 664 is repositioned to engage the fish 666. The fish 666 may be moved from the wash-out region 654 by reactivating the knuckle joints 672. The fish 666 is retrieved by retrieving the tool 650. It should be noted that any suitable imaging and fishing devices may be utilized for the purpose of this application. The fishing tools of this invention preferably have degrees of freedom of movement that are sufficient to position the tool to retrieve the fish at any place in the wellbore.

Thus far selected examples of the downhole service tool have been described above to illustrate the concepts of the present invention. It will, however, be understood that many other end work devices and imaging devices can be utilized to image an object and work site in a wellbore and to perform a desired operation at the work site without requiring retrieving the service tool according to the concepts of this invention. For example, the service tool 200 (FIG. 1) of the present invention may be utilized to locate a weak point in the well casing, such as a crack or a pit, and perform welding. The service tool 200 may be utilized to perform swaging operations downhole or to inject polymers into the wellbore. Yet, in certain other applications, it is desirable to confirm the engagement of a tool conveyed from the surface to downhole device prior to performing an operation with such tool. The service tool of the present invention may include an engagement device and a sensor for generating signals that differ when the tool is engaged with the downhole device and when it fully or properly engaged. The service tool may include without limitation any desired engagement device, including a collet type device, a screw type device, a latching device that is designed to latch into or onto a receptacle associated with the downhole device, a cone type device, a device that is designed to mate with a matching profile in the downhole device, or a collet or a pressure activated device. To perform the desired operation, the service tool is placed at a desired location in the wellbore and the sensor is activated to provide the tool response. The tool is engaged with the downhole device. The sensor continues to provide signals responsive to the engagement process. The response signature is utilized to confirm the engagement of the tool device with the downhole device.

Additionally, the service tool 200 may incorporate one or more robotics devices that can remove a member or a sensor, install a sensor or a device, such as a fluid control valve, remove a liner, interchange parts, replace power sources, such as batteries, turbines, etc., inflate a device, manipulate a device or part downhole from its current position to a new position, such as a sliding sleeve from an open position to a closed position or vice versa, and perform any other desired function. The image device in the service tool is preferably utilized to locate the part to be replaced, installed or manipulated.

It is often desirable to measure selected wellbore and formation parameters either prior to or after performing an end work. Frequently, such information is obtained by logging the wellbore prior to performing the end work, which typically requires an extra trip downhole. The service tool of the present invention, such as tool 200 shown in FIG. 1 and other tools shown in FIGS. 2–16 may include one or more logging devices or sensors. For example, for the work to be performed in cased holes, such as shown in FIGS. 10*a*–14, a collar locator may be incorporated in the service tool 200 to log the depth of the tool 200 while tripping downhole. Collar locators provide relatively precise measurements of the wellbore depth and can be utilized to correlate depth measurement made from surface instruments, such as wheel type devices. The collar locator depth measurements can be utilized to position and locate the imaging and end work devices of the tool 200 in the wellbore. Also, casing inspection devices, such as eddy current devices or magnetic devices may be utilized to determine the condition of the casing, such as pits and cracks. Similarly, a device to determine the cement bond between the casing and the formation may be incorporated to obtain a cement bond log during tripping downhole. Information about the cement bond quality and the casing condition are especially useful for wellbores which have been in production for a relatively long time period or wells which produce high amounts of sour crude oil or gas. Additionally, resistivity measurement devices may be utilized to determine the presence of water in the wellbore or to obtain a log of the formation resistivity. Similarly gamma ray devices may be utilized measure background radiation. Other formation evaluation sensors may also be utilized to provide corresponding logs while tripping into or out of the wellbore.

The description thus far substantially relates to a service tool which utilizes an image sensor and an end work device to image a work site in a wellbore and perform a selected end work. As described earlier, the service tool of the present invention also provides confirmation about the quality and effectiveness of the end work performed downhole during the same trip. The general operation of the above-described tools is described by way of an example of a functional block diagram for use with the system of FIG. 1. Such methods and operations are equally applicable to the other downhole service tools made according to the present invention. Such operations will now be described while referring to FIG. 17.

The downhole section of the control circuit 900 preferably includes a microprocessor-based downhole control circuit 910. The control circuit 910 determines the position and orientation of the tool as shown in box 912. A circuit 915 controls the operation of the downhole tool. The control circuit 910 also controls the end work devices, such as cutting tool 914*a* and any other end work devices, generally designated herein by numeral 914*n*. During operations, the control circuit 910 receives information from other downhole devices and sensors, such as a depth indicator 918 and orientation devices, such as accelerometers and gyroscopes. The control unit 900 communicates with the surface control unit 970 via the downhole telemetry 939 and via a data or communication link 939*a*. The control circuit 910 also preferably controls the operation of the downhole devices, such as the power unit 934, stabilizers and other desired downhole devices (not shown). The downhole control circuit 910 includes a memory 920 for storing therein data and programmed instructions. The surface control unit 970 preferably includes a computer 930, which manipulates data, a recorder 932 for recording images and other data and an input device 934, such as a keyboard or a touch screen for inputting instructions and for displaying information on the monitor 972. The surface control unit 970 and the downhole tool communicate with each other via a suitable two-way telemetry system.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A downhole tool for imaging a work site within a pre-existing wellbore and performing a tool operation at the work site during a single trip of the downhole tool in the wellbore, the downhole tool comprising;

(a) an imaging device carried by the downhole tool for imaging the work site; and (b) a work device carried by the downhole tool for performing the tool operation at the work site;

whereby the downhole tool obtains the image of the work site and performs the tool operation at the work site during a single trip of the downhole tool into the wellbore.

2. The downhole tool of claim 1, wherein the imaging device is selected from a group consisting of a camera for optical viewing, an acoustic device, an ultrasonic device, an infra-red device, an RF device, a microwave device, a contacting device, a tactile device, and a fiber optic device.

3. The downhole tool of claim 1, further comprising a transmitter for transmitting data of the image of the work site to a surface location.

4. The downhole tool of claim 1, wherein the imaging device is a contacting device comprising at least one projection extending from the downhole tool that contacts with the work site to obtain the image of the work site.

5. The downhole tool of claim 3, wherein the transmitter is selected from a group consisting of an electromagnetic transmitter, a fluid acoustic transmitter, a tubular fluid transmitter, a mud-pulse transmitter, a fiber optic transmitter, and a conductor wire transmitter.

6. The downhole tool of claim 1, wherein the work device is selected from a group consisting of a fishing tool to engage with a fish, a whipstock, a diverter, a re-entry tool, an anchor, a packer, a seal, an inflatable packer, a plug, a perforating tool, a fluid stimulation tool, an acidizing tool, a fluid fracturing tool, a milling tool, a cutting tool, a patch tool, a drilling tool, a cladding tool, a welding tool, a deforming tool, a sealing tool, a cleaning tool, a device for installing a device in the wellbore, a device for removing a device downhole, a testing device for performing a test in the wellbore, an inspection device, and a tool for engaging with a downhole object to perform a desired operation.

7. The downhole tool of claim 1 further comprising a computer having at least one processor for controlling the operation of the work device.

8. The downhole tool of claim 1, wherein the work device is movable radially and longitudinally relative to the wellbore.

9. The downhole tool of claim 1 further comprising a memory device for recording data of the image of the work site for retrieval when the downhole tool is brought out of the wellbore.

10. The downhole tool of claim 1 further comprising a memory device containing work site data, said downhole tool correlating data generated by the downhole tool with the work site data to facilitate identification of the image of the work site.

11. The downhole tool of claim 10, wherein a transmitter in said downhole tool generates signals for transmission to a surface location representative of the data of the work site generated by the downhole tool.

12. The downhole tool of claim 11, wherein the transmitter communicates with other equipment in the wellbore.

13. The downhole tool of claim 1 further comprising a receiver for receiving signals sent from a surface location to the downhole tool.

14. The downhole tool of claim 1 further comprising a formation evaluation sensor for providing measurements of a parameter of interest of the formation surrounding the wellbore.

15. The downhole tool of claim 1 further comprising at least one sensor for determining an operating condition of the downhole tool, said operating condition being one of temperature, pressure, fluid flow, tool orientation, pull force, gripping force, tool centerline position, tool configuration, inclination, and acceleration.

16. The downhole tool of claim 1, wherein the imaging device obtains image of an object positioned downhole of the downhole tool.

17. The downhole tool of claim 1, wherein the imaging device is an ultrasonic device to provide image of the work site located downhole of the downhole tool.

18. The downhole tool of claim 17, wherein the ultrasonic device includes at least one transmitter for transmitting signals to the work site downhole of the downhole tool and a receiver for receiving signals reflected by the work site in response to the transmitted signals.

19. The downhole tool of claim 18, wherein the imaging device operates the transmitter by sweeping a preselected frequency range to obtain an effective operating frequency and continues to operate the transmitter at such effective frequency to generate data representative of attributes of the work site.

20. The downhole tool of claim 1, wherein the imaging device is beam-steered to generate data representative of the properties of the work site.

21. The downhole tool of claim 1, wherein the imaging device includes a sensor that is rotated to generate data representative of the properties of the work site.

22. The downhole tool of claim 1, wherein the work device is a cutting device that performs cutting with a high pressure fluid.

23. The downhole tool of claim 1, wherein the work device is a reentry device that includes an orienting device that can be oriented to cause the reentry device to enter into a lateral wellbore intersecting the wellbore.

24. The downhole tool of claim 23, wherein the orienting device is selected from a group of devices consisting of a knuckle joint, a flexible joint that is operated by a control circuit in the downhole tool, a flexible joint that is remotely operable, and a deflection device that re-orients the downhole tool when said deflection device is urged against the wellbore.

25. The downhole tool of claim 1 further comprising two spaced-apart isolators, said isolators isolating a zone of interest in the wellbore.

26. The downhole tool of claim 25 further comprising a device for injecting fluid into the zone of interest to perform testing of the zone of interest.

27. The downhole tool of claim 25, wherein the isolated zone is selected from the group consisting of a perforated zone, and juncture between the wellbore and a lateral wellbore.

28. The downhole tool of claim 1, wherein the imaging device is a tactile device having at least one probe that extends from the downhole tool to make contact with the work site to provide signals representative of a physical attribute of the work site.

29. A method of imaging a location constituting a work site of interest at which a tool operation is to be performed in a pre-existing wellbore and performing a work at the work site during a single trip, comprising:

(a) conveying a downhole tool with a tubing extending from a surface location down into the wellbore, said downhole tool carrying a sensor adjacent a lower end of the tool for sensing properties associated with the image of the work site and generating data representative of the image of the work site, a transmitter transmitting signals representative of the data to the surface location and an end work device for performing the tool operation;

(b) positioning the tool adjacent the work site;

(c) sensing properties associated with an image of the work site downhole;

(d) generating data representative of the image of the work site;

(e) transmitting the data to the surface location; and (f) performing the tool operation at the work site [location during the single trip of the downhole tool into the wellbore.

30. A method of imaging a work site and performing an end work at the work site in a pre-existing wellbore during a single trip into the wellbore, comprising:

(a) conveying a downhole tool into the wellbore, said downhole tool having an imaging device for imaging a work site in the wellbore, a device for isolating the work site, and an end work device for performing a desired work at the work site;

(b) isolating the work site;

(c) imaging the work site by the imaging device; and (d) operating the end work device to perform a desired operation at the work site during the single trip of the downhole tool into the wellbore.

31. A method of imaging a location constituting a work site of interest in a preexisting wellbore at which a desired operation is to be performed without removing the tool from the wellbore, comprising:

(a) positioning a downhole tool adjacent the work site, said downhole tool having an imaging device for sensing properties associated with the work site and generating data representative of the work site, a transmitter for receiving the data and transmitting signals representative of the data to a surface location and an end work device for performing the desired tool operation;

(b) generating data representative of the work site and transmitting signals representative of the data to the surface location by the transmitter; and (c) performing the desired tool operation at the work site location during a single trip of the tool into the wellbore.

32. A downhole oilfield service tool for imaging a work site in a wellbore and for performing a desired operation at the work site without requiring retrieving of the service tool from the wellbore prior to performing the desired operation, said service tool conveyable into the wellbore by a tubing extending from a surface location toward and adjacent the work site, comprising:

(a) an ultrasonic sensor adjacent a lower end of the tubing for providing an image of the work site and generating data representative of said image;

(b) a transmitter associated with the service tool for receiving the data generated by the sensor and transmitting signals representative of said data to the surface; and (c) a milling tool adjacent the lower end of the tubing for performing the desired operation at the work site based at least partially upon said data without retrieving the service tool from the wellbore prior to performing the desired operation.

33. A downhole service tool for entry into a branch wellbore from a juncture at a main wellbore to perform an end work at a work site in the branch wellbore during a single trip into the main wellbore, comprising:

(a) a sensor adapted to obtain data for an image of the juncture;

(b) a control circuit in the service tool for receiving the data from the sensor and transmitting signals representative of said data to the surface to obtain the image of the juncture;

(c) a tool orientation device in the service tool, said device adapted to be operated downhole by the control circuit, to cause the service tool to enter the branch wellbore; and (d) an end work device for performing the end work at the work site in the branch wellbore, whereby the service tool can locate the juncture, enter into the branch wellbore from the main wellbore and perform the desired operation at the work site in a single trip.

34. The downhole service tool of claim 33, wherein the tool orientation device is selected by a group consisting of a knuckle joint that is controlled from a command signal from the surface, a knuckle joint that is controlled downhole, a plurality of independently adjustable pads, and a member that extends outward from the service tool to urge against the wellbore to cause the service tool to move transverse to the wellbore axis.

35. A downhole service tool for imaging a selected work site in a wellbore and performing a welding operation at the selected work site in a wellbore during a single trip, comprising:

(a) a sensor adapted to obtain data to image the work site;

(b) a control circuit in the service tool for receiving the data from the sensor and transmitting signals representative of said data to the surface to obtain the image of the work site; and (c) a welding device in the service tool, said welding device adapted to be operated downhole by the control circuit to perform the welding operation at the work site during the single trip.

36. The downhole service tool of claim 35, wherein the selected work site is selected from a group consisting of a joint between casing in a main wellbore and a branch wellbore formed from the main wellbore and a packer.

37. A downhole oilfield service tool conveyable into a wellbore for imaging a location constituting a work site of interest downhole and performing a testing operation at the work site during a single trip of the tool in the wellbore, the tool comprising;

(a) a sensor for sensing properties associated with the desired work site in the wellbore and generating data representative of the work site;

(b) a transmitter for receiving the data from the sensor and transmitting signals representative of said data to the surface; and (c) a pair of spaced apart seals on the service tool to seal at least a portion of the work site of interest between the pair of seals; and (d) a testing device in the tool to perform a selected test in the sealed work site, during the single trip.

38. The downhole service tool of claim 37, wherein the selected work site is a perforated zone.

39. The downhole service tool of claim 38, wherein the testing device performs a test selected from a group consisting of pressure test of a sealed region, pressure build-up over a time period, temperature test, temperature build-up over a time period, reservoir analysis, formation evaluation, resistivity of formation fluids, sample collection, formation fluid analysis, and hydrocarbon content of formation fluids.

40. A downhole tool conveyable into a wellbore for imaging a location constituting a work site of interest downhole and performing a workover operation at the work site during a single trip of the tool in the wellbore, the downhole tool comprising;

(a) a sensor for sensing properties associated with the image of the work site in the wellbore and generating data representative of the image of the work site;

(b) a transmitter for receiving the data from the sensor and transmitting signals representative of said data to the surface; and (c) a pair of spaced-apart seals on the service tool to seal at least a portion of the work site of interest between the pair of seals; and (d) a device for injecting a pressurized fluid into the sealed portion of the work site to perform the workover operation, during the single trip of the downhole tool into the wellbore.

41. The downhole service tool of claim 40, wherein the work site of interest is a perforated region and the sealed portion includes at least one perforation.

42. The downhole service tool of claim 41, wherein the fluid is selected from a group consisting of cement slurry, polymer, water, steam, chemicals, and acidizing fluids.

43. The downhole service tool of claim 40, wherein the workover operation is selected from the group consisting of injecting fluids into a perforated zone to improve hydrocarbon production, sealing of a zone to prevent production of fluids therefrom, cementing, fracturing, and cleaning.

44. An imaging tool for obtaining an image of a work site in a wellbore, said wellbore having wellbore fluid therein, the imaging tool comprising:

(a) a fluid injection system for displacing wellbore fluid adjacent the work site with a substantially transparent fluid; and (b) a camera associated with the imaging tool for taking an image of the work site.

45. The imaging tool of claim 44, wherein the imaging tool is conveyable into the wellbore by a conveying device selected from a group consisting of a wireline, a tubing and a traction device that can move the imaging tool through the wellbore.

46. The imaging tool of claim 44, wherein the camera is adapted to be remotely oriented in a desired direction to take an image of the work site.

47. The imaging tool of claim 44 further having a control unit at the surface coupled to said imaging tool for receiving data from the camera and for displaying the image of the work site.

48. The imaging tool of claim 43 further having a control circuit within the imaging tool for automatically controlling the operation of the fluid injection system and for operating the camera to obtain the desired image of the work site according to programmed instructions provided to the control circuit.

49. The imaging tool of claim 44 further having a control circuit within the imaging tool for controlling the operation of the fluid injection system and for operating the camera to obtain the image of the work site according to instructions provided to the control circuit.

50. The imaging tool of claim 43, wherein the fluid injection system comprises:

(i) a source of substantially transparent fluid; and (ii) a fluid transfer mechanism for displacing the at least a portion of the substantially non-transparent fluid with the substantially transparent fluid wellbore.

51. The imaging tool of claim 44, wherein the fluid injection system comprises:

(i) a source of substantially transparent fluid; and (ii) a fluid transfer mechanism for displacing at least a portion of the wellbore fluid with the substantially transparent fluid.

52. The imaging tool of claim 51 further having a fluid communication line coupled to a fluid chamber for retrieving the substantially transparent fluid from the wellbore into the fluid chamber.

53. The imaging tool of claim 43, wherein the device for providing the seal is a packer.

54. The imaging tool of claim 44, further comprising a seal for isolating wellbore fluid adjacent said work site.

55. A method for imaging a work site of interest located within a wellbore containing a substantially non-transparent fluid therein, said method comprising:

(a) conveying an imaging tool within the wellbore to a location above the work site;

(b) isolating utilizing at least one seal the work site;

(c) displacing the substantially non-transparent fluid in the work site with a substantially transparent fluid; and (d) obtaining an image of the work site with the imaging tool.

56. A method for imaging a work site located within a wellbore containing a substantially non-transparent fluid therein, said method comprising:

(a) conveying an imaging tool within the wellbore to a location adjacent the work site;

(b) isolating the work site with a seal in the wellbore;

(c) displacing the substantially non-transparent fluid in the work site with a substantially transparent fluid; and (d) obtaining an image of the work site with the imaging tool.

57. The method of claim 56 further comprising communicating the image of the work site to a surface location.

58. An imaging tool for obtaining an image of a work site within a wellbore, comprising:

(a) a tool body conveyable into the wellbore;

(b) a flexible inflatable device on the tool body having a plurality of spaced sensors arranged at a plurality of predetermined surface locations on the inflatable flexible device, each such sensor providing a signal in response to deformation of the surface locations of the flexible inflatable device at which such sensor is placed relative to a predetermined norm for such sensor; and (c) a computer, said computer receiving signals from the sensors in the plurality of sensors when the inflatable flexible device is inflated and urged against the work site and in response thereto providing an image of the work site.

59. The imaging tool of claim 57, wherein the computer is located within the imaging tool for computing the image of the work site downhole during operation of the imaging tool.

60. The imaging tool of claim 58, wherein the computer is located within the imaging tool for computing the image of the work site downhole.

61. The imaging tool of claim 57 further having a fluid injection system for injecting a fluid into the inflatable flexible device.

62. A downhole oilfield service tool for imaging a work site in a wellbore and for performing a desired operation at the work site during a single trip of the service tool conveyed into the wellbore by a tubing extending from a surface location toward and adjacent to the work site, comprising:

(a) an imaging device adjacent a lower end of the tubing for providing an image of the work site; and (b) an end work device adjacent the lower end of the tubing for performing the desired operation at the work site based at least partially upon the image of the work site during the single trip of the service tool in the wellbore.

* * * * *